US009237394B2

(12) United States Patent
Seo et al.

(10) Patent No.: US 9,237,394 B2
(45) Date of Patent: Jan. 12, 2016

(54) CANAL TYPE EARPHONE WITH PRESSURE EQUILIBRIUM MEANS

(71) Applicant: BUJEON CO., LTD., Ansan-si, Gyeonggi-do (KR)

(72) Inventors: Dong Hyun Seo, Ansan-si (KR); Seung Cheol Lee, Seoul (KR); Su Cheon Lee, Ansan-si (KR)

(73) Assignee: BUJEON CO., LTD., Ansan-si, Gyeonggi-do (KR)

( * ) Notice: Subject to any disclaimer, the term of this patent is extended or adjusted under 35 U.S.C. 154(b) by 0 days.

(21) Appl. No.: 14/287,565

(22) Filed: May 27, 2014

(65) Prior Publication Data

US 2014/0348372 A1 Nov. 27, 2014

(30) Foreign Application Priority Data

May 24, 2013 (KR) ..... 10-2013-0059288
May 23, 2014 (KR) ..... 10-2014-0062509

(51) Int. Cl.
*H04R 25/00* (2006.01)
*H04R 1/10* (2006.01)

(52) U.S. Cl.
CPC ..... *H04R 1/1016* (2013.01); *H04R 2460/11* (2013.01)

(58) Field of Classification Search
CPC ..... H04R 1/1016; H04R 2060/09; H04R 2460/114; H04R 2460/11
See application file for complete search history.

(56) References Cited

U.S. PATENT DOCUMENTS 6,738,487 B1 * 5/2004 Nageno ..... H04R 1/1016 381/312
8,111,857 B2 * 2/2012 Kuhtz ..... H04R 1/1016 381/370
2010/0080400 A1 * 4/2010 Sibbald ..... H04R 3/002 381/71.6
2010/0322453 A1 * 12/2010 Matsuyama ..... H04R 1/2857 381/380
2012/0201406 A1 * 8/2012 Yamaguchi ..... H04R 1/1016 381/309
2013/0148830 A1 * 6/2013 Sakaguchi ..... H04R 1/1058 381/312

* cited by examiner

*Primary Examiner* — Curtis Kuntz
*Assistant Examiner* — Ryan Robinson
(74) *Attorney, Agent, or Firm* — Novick, Kim & Lee, PLLC; Jae Youn Kim

(57) ABSTRACT

Disclosed herein is a canal type earphone with a pressure equilibrium means, capable of eliminating a pressure difference between a user's external auditory meatus and an outside during wearing of the canal type earphone. A pressure equilibrium means includes a side air passage through which air within a tube or air within a speaker unit in the canal type earphone is discharged to a side surface of a gasket or a side surface of the speaker unit, and a rear air passage through which air in the side surface of the speaker unit is discharged to the rear of the speaker unit.

11 Claims, 25 Drawing Sheets

CANAL TYPE EARPHONE WITH PRESSURE EQUILIBRIUM MEANS

BACKGROUND OF THE INVENTION

1. Field of the Invention

The present invention relates to a canal type earphone, and more particularly to a canal type earphone with a pressure equilibrium means, capable of eliminating a pressure difference between a user's external auditory meatus and an outside during wearing of the canal type earphone.

2. Description of the Related Art

A canal type earphone is a type of a speaker converting electric energy into acoustic energy, and enables listening by transferring vibration to an eardrum of an ear instead of emitting sound into a space.

The canal type earphone is put in a user's ear and enables speaker sound to be directly transferred into the user's ear. Since the canal type earphone enables listening to sound even at small output and rarely causes discomfort to those around a user in the course of listening, it is widely used for audio equipment such as a mobile phone and an MP3 player.

Earphones may be mainly classified into an open type earphone and a canal type earphone according to a method of wearing them on the ear. The open type earphone is adapted to wear the earphone as if to put it on an ear, and deteriorates sound insulation due to generation of a space therebetween since people have different ear shapes. On the other hand, the canal type earphone is adapted to insert the earphone into a user's ear, and uses earpieces (tips) having various sizes. Accordingly, the canal type earphone is wearable and has excellent sound insulation, compared to the open type earphone.

Although the canal type earphone is suitable to be used in a noisy place because of having excellent sound insulation, there is a problem in that a differential pressure may be generated due to a complete blockage between a user's external auditory meatus and an outside.

FIG. 1 shows an example of a conventional canal type earphone 1. As shown in the drawing, the canal type earphone includes a speaker unit 10, a housing 20 receiving the speaker unit 10, and an earpiece 23 installed on an outer surface of a cylindrical tube 25 which is integrally formed at the front of the housing 20.

The housing 20 defines a space for receiving the speaker unit 10, and is divided into a first housing 11*a* and a second housing 11*b* so as to easily mount the speaker unit 10. The tube 25 is integrally formed on a front surface of a first housing 11 so as to emit sound emitted from the speaker unit 10 into a user's ear. The tube 25 has a cylindrical shape and the earpiece 23 is fitted on an outer surface of the tube 25.

The earpiece 23 is made of a soft material such as silicon, and is formed of a shape and size corresponding to a user's external auditory meatus. The earpiece 23 is inserted into the user's external auditory meatus, thereby preventing sound emitted from the speaker unit 10 from leaking to the outside or preventing external noise from being transferred into the user's ear.

As shown in FIG. 2, when a user inserts the canal type earphone 1 into a user's external auditory meatus 2, the user's external auditory meatus 2 is completely blocked from the outside by the earpiece 23 installed to the canal type earphone 1. When the speaker unit 10 vibrates in a state in which air within the user's external auditory meatus may not be discharged to the outside, a pressure in the external auditory meatus is gradually increased so that a pressure difference is generated between the inside of the external auditory meatus and outdoor air.

As such, when a pressure difference is generated between the external auditory meatus and the outside, an eardrum 3 inside the external auditory meatus 2 is pressurized. For this reason, a user may not properly listen to sound emitted from the speaker unit 10, and a user's eardrum is also damaged in severe cases.

To solve these problems, the conventional canal type earphone has a vent groove g formed on an inside surface of the earpiece 23 coupled to the tube 25 or a vent hole h formed on the tube coupled with the earpiece, as shown in FIG. 1. Consequently, it may be possible to prevent generation of a differential pressure by discharging air within the external auditory meatus to the outside through the vent groove g or the vent hole h.

However, when the vent groove g is formed between the earpiece and the housing or the vent hole h is formed on the tube wrapped by the earpiece as in the related art, there is a problem in that the vent groove g or the vent hole h may be closed by the earpiece or the external auditory meatus when the earpiece is inserted into the external auditory meatus.

In addition, since the conventional vent groove g or the conventional vent hole h has a very short length for air passage and air within the tube is immediately discharged to the outside, there is a problem in that it is difficult to minutely adjust a discharge amount of air.

[Patent Document] Korean Patent Publication No. 10-0633050 (canal type earphone)

SUMMARY OF THE INVENTION

Therefore, the present invention has been made in view of the above problems, and it is an object of the present invention to provide a canal type earphone with a pressure equilibrium means, capable of eliminating a differential pressure such that air in an external auditory meatus may be discharged rearward of a speaker unit during wearing of the canal type earphone, of minimizing a change in sound to have good sound quality, and of preventing damage of an eardrum.

It is another object of the present invention to provide a canal type earphone with a pressure equilibrium means, capable of installing an air passage, through which air in an external auditory meatus is discharged rearward of a speaker unit, to the speaker unit so as to prevent the air passage from being closed by an earpiece or the external auditory meatus.

It is a further object of the present invention to provide a canal type earphone with a pressure equilibrium means, capable of adjusting a discharge amount of air by lengthways forming an air passage through which air in an external auditory meatus is discharged rearward of a speaker unit.

In accordance with an aspect of the present invention, the above and other objects can be accomplished by the provision of a canal type earphone with a pressure equilibrium means, the canal type earphone including a speaker unit, a housing receiving the speaker unit, and an earpiece installed on an outer surface of a tube which is integrally formed at the front of the housing, the canal type earphone having a gasket installed between the speaker unit and the housing, the canal type earphone including a pressure equilibrium means for discharging air within the tube or air within (between a cover and a vibration plate) the speaker unit to the rear of the speaker unit.

The pressure equilibrium means may include a side air passage through which air within the tube or air within the speaker unit is discharged to a side surface of the gasket or a side surface of the speaker unit, and a rear air passage through which air in the side surface of the speaker unit is discharged to the rear of the speaker unit.

The side air passage may be configured of a vent groove which is radially formed on a front or back surface of the gasket, and the vent groove may be connected, at one end thereof, to a through-hole formed at a center of the gasket while being connected, at the other end thereof, to the side surface of the gasket.

The side air passage may be configured of a vent groove which is radially formed on a front surface of a cover integrally formed at a front end of a frame constituting the speaker unit, and the vent groove may be connected, at one end thereof, to a through-hole formed at a center of the cover while being connected, at the other end thereof, to a side surface of the cover.

The side air passage may be configured of a vent groove which is formed on a front surface plate, the front surface plate being integrally formed at a front end of the housing such that the gasket is pressed against the front surface plate, and the vent groove may be connected, at one end thereof, to a through-hole formed at a center of the front surface plate while being connected, at the other end thereof, to an edge of the front surface plate.

The side air passage may be configured of a vent hole formed on a cover and a vent groove formed on a back surface of the gasket installed on a front surface of the cover, the vent hole may be formed at a position spaced apart from a through-hole formed at a center of the cover by a predetermined distance, and the vent groove may be connected, at one end thereof, to the vent hole while being connected, at the other end thereof, to the side surface of the gasket.

The side air passage may be configured of a first vent hole formed on the gasket installed on a front surface of a cover, a vent groove formed on a back surface of the gasket, and a second vent hole formed on the cover, the first vent hole may be formed at a position spaced apart from a through-hole formed at a center of the gasket by a predetermined distance, the second vent hole may be formed at a position spaced apart from a through-hole formed at a center of the cover by a predetermined distance, and the vent groove may be connected, at one end thereof, to the first vent hole while being connected, at the other end thereof, to the second vent hole.

The side air passage may be configured of a through-hole formed at a center of a cover and a through-hole formed on a side surface of a frame constituting the speaker unit, and the through-hole may be formed between the cover and a vibration plate installed within the frame.

The rear air passage may be configured of a gap formed between an inside surface of the housing and an outside surface of the speaker unit.

The rear air passage may be configured of a vent groove formed on an inside surface of a frame constituting the speaker unit.

The rear air passage may be configured of a through-hole formed at one side of a cover and a vent groove formed on an inside surface of a frame constituting the speaker unit such that the vent groove is connected to the through-hole.

The pressure equilibrium means may include an inside rear air passage through which air within the tube is discharged between a bracket and a yoke of the speaker unit, an inside front air passage through which air between the yoke and the bracket is discharged to the front of the speaker unit, and a rear air passage through which air in the front of the speaker unit is discharged to the rear of the speaker unit.

The inside rear air passage may be configured of a vent hole formed at one side of a cover and a vent groove formed on an inside surface of a frame constituting the speaker unit, the vent hole may be installed at a position spaced apart from a through-hole formed at a center of the cover and the side surface of the gasket by a predetermined distance, and the vent groove may be connected, at an upper end thereof, to the vent hole while being connected, at a lower end thereof, between the bracket and the yoke within the speaker unit.

The inside front air passage may be configured of a vent groove formed on an inside surface of a frame constituting the speaker unit and a vent hole formed at one side of a cover, the vent hole may be installed at a position spaced apart from a through-hole formed at a center of the cover and the side surface of the gasket by a predetermined distance, and the vent groove may be connected, at an upper end thereof, to the vent hole while being connected, at a lower end thereof, between the bracket and the yoke within the speaker unit.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Hereinafter, a canal type earphone with a pressure equilibrium means according to the present invention will be described in more detail with reference to the drawings.

Figure 1:
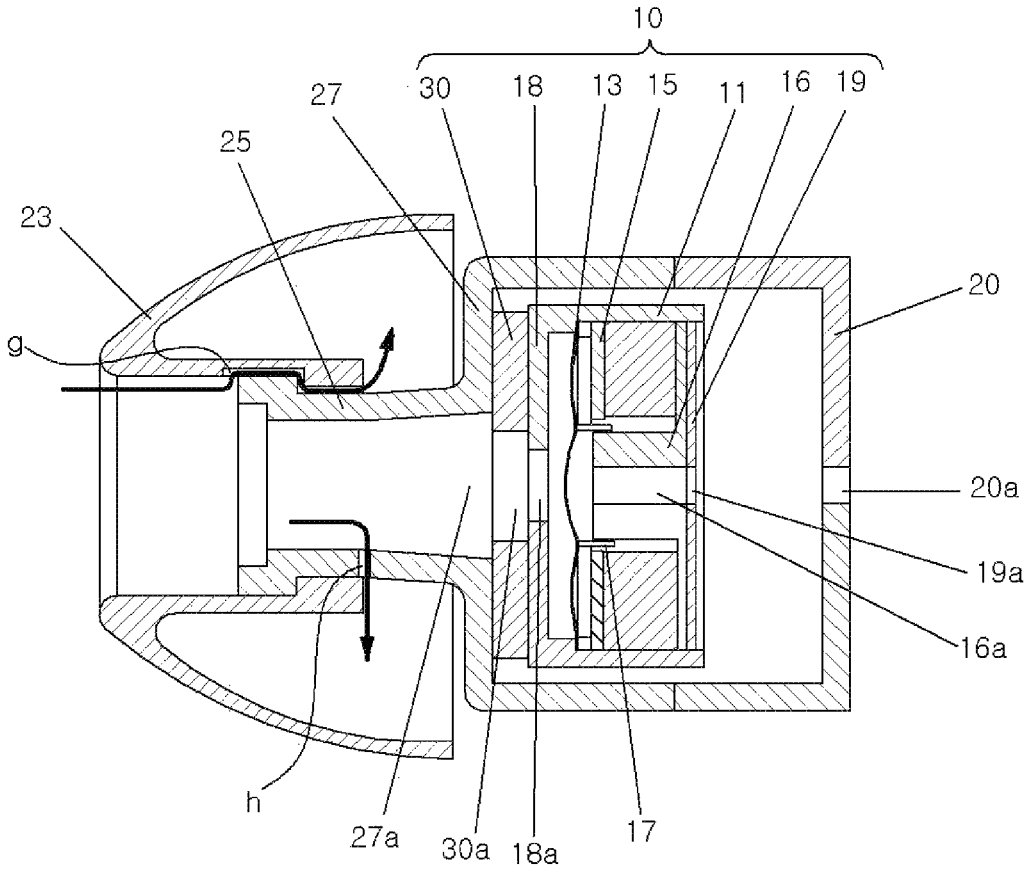
PRIOR ART FIG. 1
FIG. 1 is a cross-sectional view illustrating an example of a conventional canal type earphone.
Figure 2:
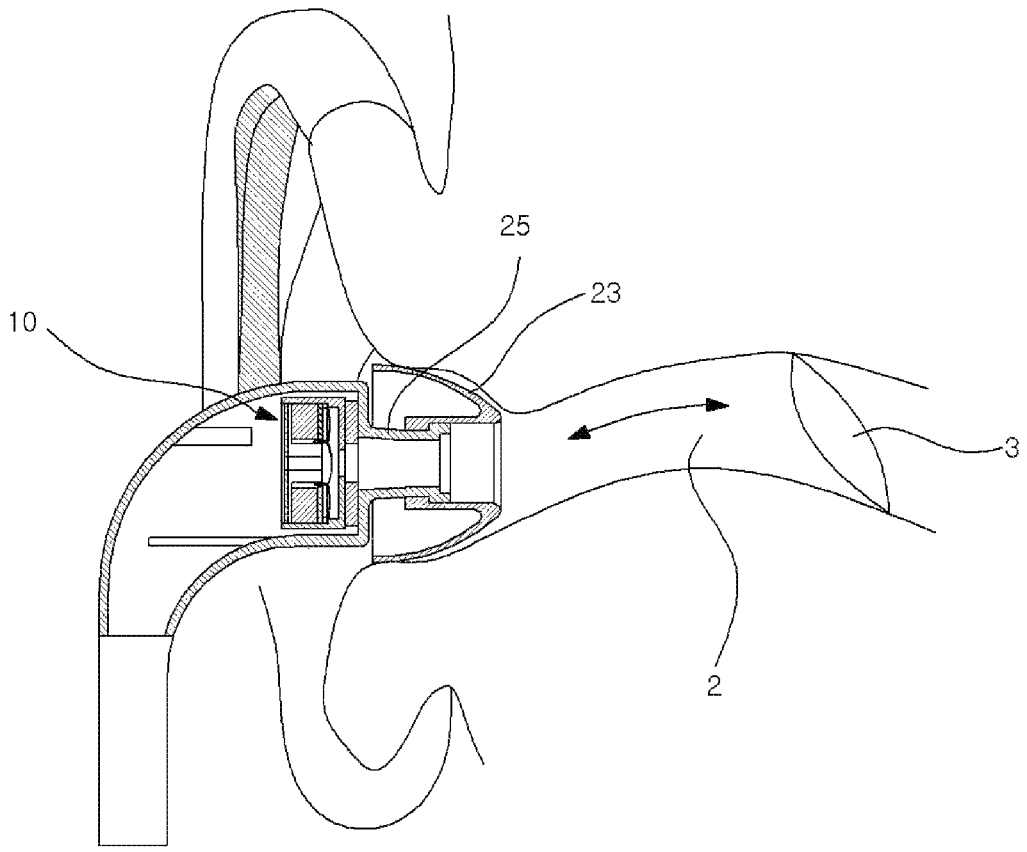
PRIOR ART FIG. 2
FIG. 2 is a cross-sectional view illustrating a state of wearing the conventional canal type earphone.
Figure 3:
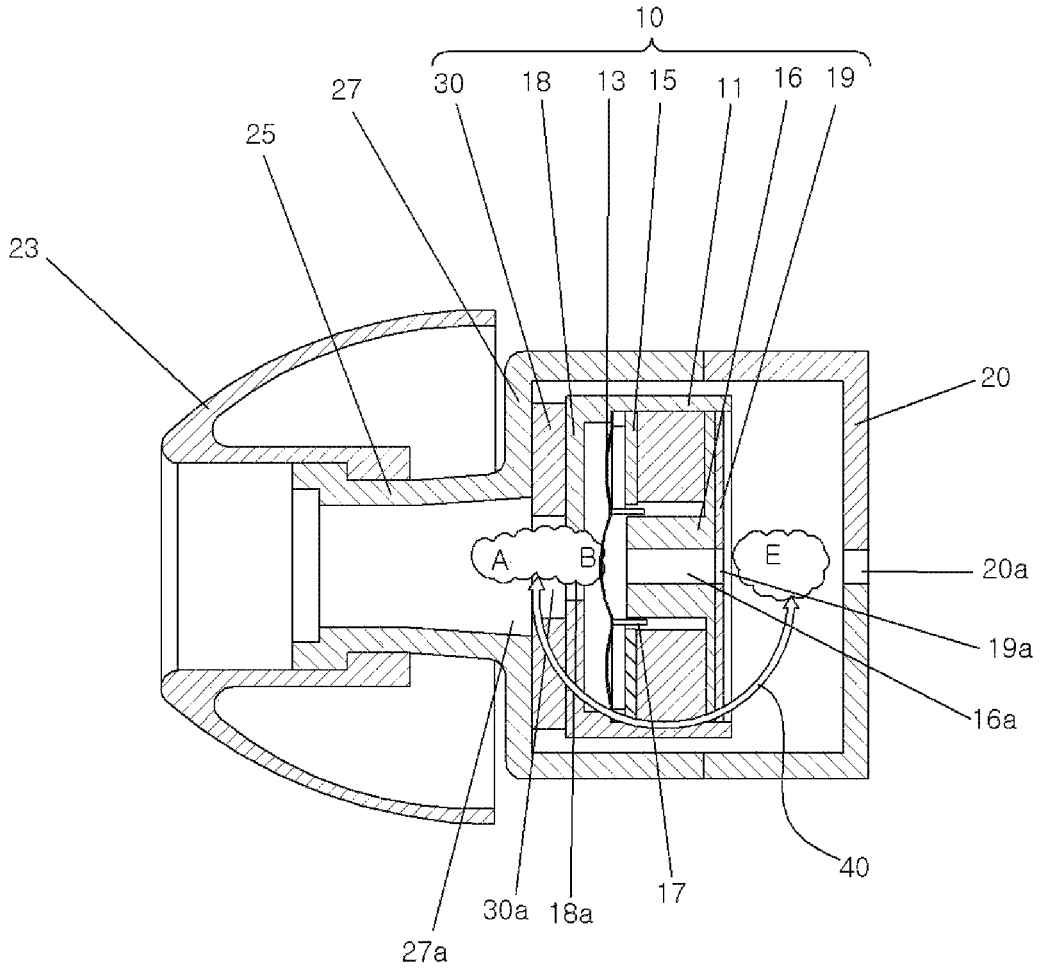
FIG. 3 is a cross-sectional view illustrating a canal type earphone with a pressure equilibrium means according to the present invention.

FIG. 3 is a cross-sectional view illustrating a canal type earphone with a pressure equilibrium means according to the present invention. As shown in the drawing, the canal type earphone with a pressure equilibrium means 1 according to the present invention mainly includes a speaker unit 10, a housing 20 receiving the speaker unit 10, an earpiece 23 installed on an outer surface of a tube 25 which is integrally formed at the front of the housing 20, and a pressure equilibrium means 40 which eliminates a pressure difference between an external auditory meatus and an outside by discharging air within the tube 25 to the rear of the speaker unit 10.

The cylindrical tube 25 is integrally formed at the front of the housing 20 so as to emit sound emitted from the speaker unit 10 into a user's ear. The earpiece 23 is inserted into a user's external auditory meatus, thereby preventing sound emitted from the speaker unit 10 from leaking to the outside or preventing external noise from being transferred into the user's ear.

The housing 20 is formed integrally with a front surface plate 27 against which the speaker unit 10 is pressed. The front surface plate 27 is configured of a flat plate such that the speaker unit 10 is pressed against the front surface plate 27, and is formed, at a center thereof, with a through-hole 27*a* connected with the tube 25.

The speaker unit 10 installed within the housing 20 includes a cylindrical frame 11, a magnetic circuit 12 installed within the frame 11, and a vibration plate 13 which vertically vibrates by magnetic force of the magnetic circuit 12. The magnetic circuit 12 includes a magnet 14, and a yoke 16 which forms an aperture between the magnet 14 and a plate 15 installed on an upper surface of the magnet 14.

The aperture is installed with a coil 17. The vibration plate 13 is attached to an upper end of the coil 17. The vibration plate 13 is configured of a thin plate, and is fixed, at an edge thereof, to an upper end of the frame 11. External electric signals are applied to the coil 17. For this reason, the coil 17 is connected with a connection terminal (not shown).

The frame 11 has a cylindrical shape. A cover 18 is installed on a front surface of the frame 11 and a bracket 19 is installed on a rear surface of the frame 11. The cover 18 has a through-hole 18*a* formed at a center thereof so that sound generated by the vibration plate 13 is emitted forward through the through-hole 18*a*. The bracket 19 has a through-hole 19*a* formed at a center thereof so that sound generated by the vibration plate 13 is emitted rearward through the through-hole 19*a*. The yoke 16 has a through-hole 16*a* formed at a center thereof so that sound generated by the vibration plate 13 is emitted rearward through the through-hole 16*a*.

A gasket 30 is installed on a front surface of the cover 18. The gasket 30 is made of an elastic material such as rubber or silicon. The gasket 30 has a through-hole 30*a* formed at a center thereof so that sound emitted from the speaker unit 10 may be emitted through the through-hole 30*a*. The gasket 30 is installed between the front surface plate 27 of the housing 20 and the cover 18 of the speaker unit 10 to prevent sound emitted to the user's external auditory meatus from leaking to the outside.

As shown in the drawing, the canal type earphone 1 according to the present invention is installed with the pressure equilibrium means 40 for eliminating a pressure difference between the user's external auditory meatus and outdoor air by discharging air in the front of the speaker unit 10 to the rear of the speaker unit 10.

In more detail, the pressure equilibrium means 40 enables air in the inside A of the tube 25, air in the inside B of the speaker unit 10, or air in the rear E of the speaker unit 10 to mutually flow. The pressure equilibrium means 40 forms an air passage through which air in the user's external auditory meatus may be discharged rearward of the speaker unit 10, so as not to generate a pressure difference between the user's external auditory meatus and the outside, thereby having good sound quality and preventing damage of a user's eardrum.

Figure 4:
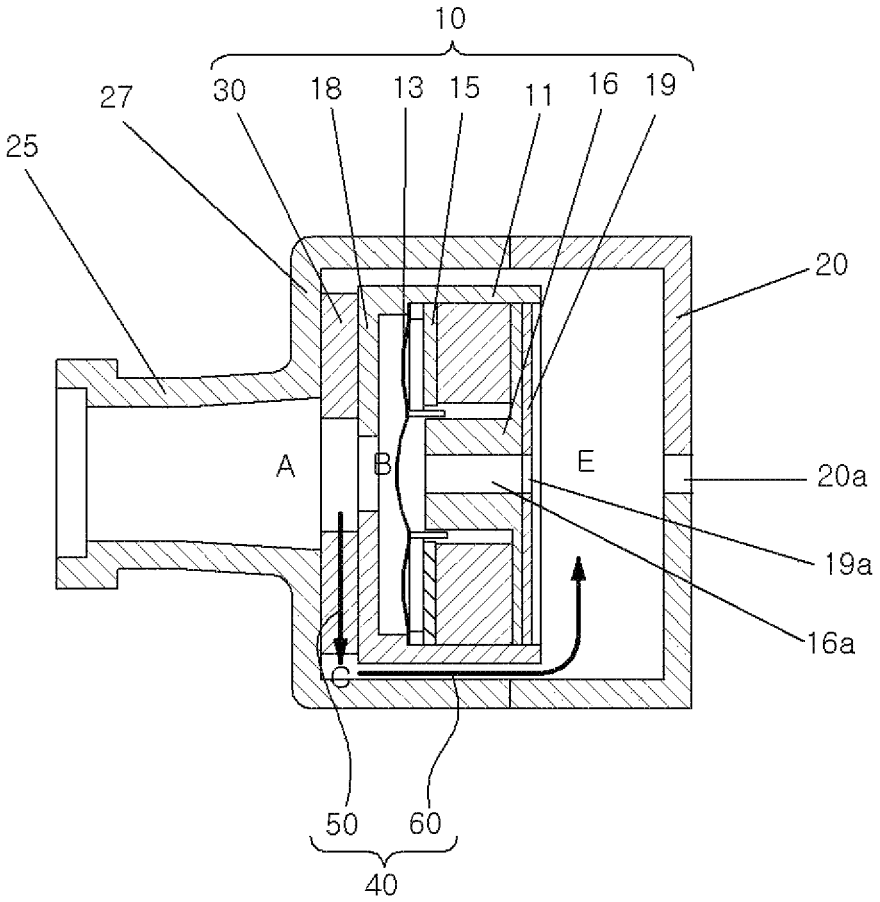
FIG. 4 is a cross-sectional view illustrating an example of a pressure equilibrium means according to the present invention.

FIG. 4 is a cross-sectional view specifically illustrating an example of the pressure equilibrium means 40 according to the present invention. As shown in the drawing, the pressure equilibrium means 40 according to the present invention includes a side air passage 50 through which air in the inside A of the tube 25 or air in the inside B of the speaker unit 10 is discharged to a side surface C of the gasket 30 or a side surface D of the speaker unit 10, and a rear air passage 60 through which air in the side surface C of the gasket 30 or the side surface D of the speaker unit 10 is discharged to the rear E of the speaker unit 10.

Figure 5:
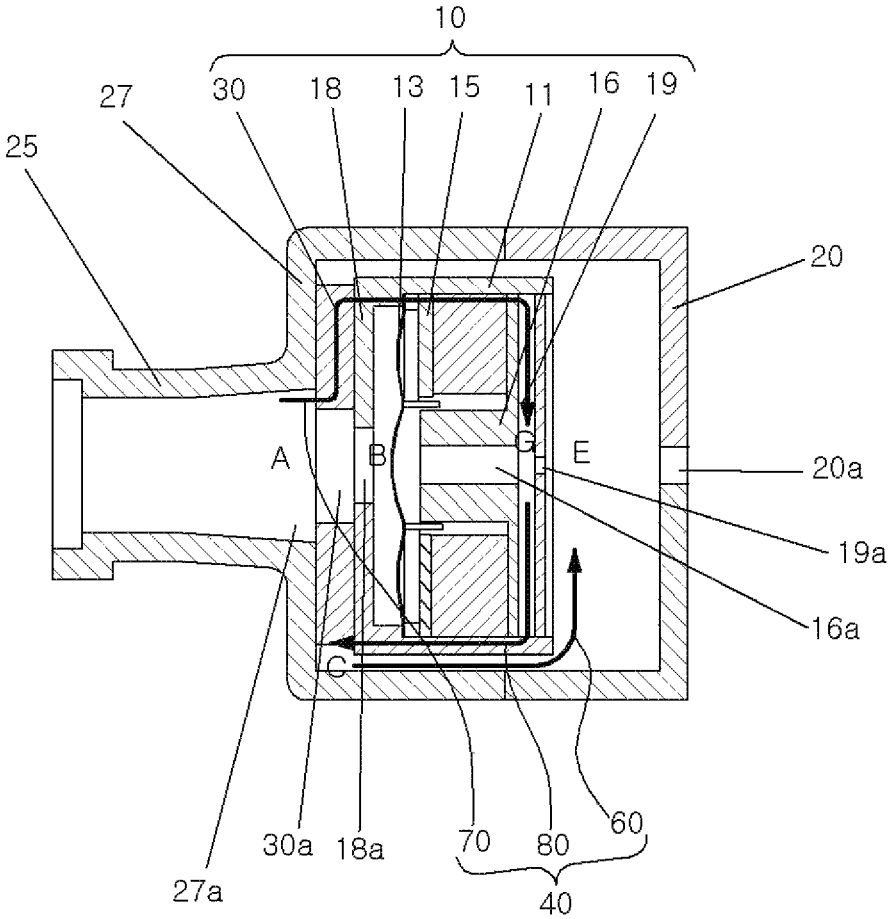
FIG. 5 is a cross-sectional view illustrating another example of the pressure equilibrium means according to the present invention.

In addition, as shown in FIG. 5, the pressure equilibrium means 40 according to the present invention includes an inside rear air passage 70 through which air in the inside A of the tube 25 is discharged to a clearance G between the bracket 19 and the yoke 16 of the speaker unit 10, an inside front air passage 80 through which air in the clearance G between the bracket 19 and the yoke 16 of the speaker unit 10 is discharged to the front surface or side surface D of the speaker unit 10, and a rear air passage 60 through which air in the side surface D of the speaker unit 10 is discharged to the rear E of the speaker unit 10.

The pressure equilibrium means 40 according to the present invention discharges air in the inside A of the tube 25 or air in the inside B of the speaker unit 10 to the rear E of the speaker unit 10 by means of using an air passage configured of the side air passage 50 and rear air passage 60, or the inside rear air passage 70, inside front air passage 80, and rear air passage 60.

Since the pressure equilibrium means 40 according to the present invention may minutely adjust a discharge amount of air by lengthways extending the length of the air passage and bending the air passage in a direction of 90 degrees by means of using the side air passage 50 and rear air passage 60, or the inside rear air passage 70, inside front air passage 80, and rear air passage 60, etc.

Hereinafter, various embodiments of the canal type earphone with a pressure equilibrium means according to the present invention will be described.

Figure 6:
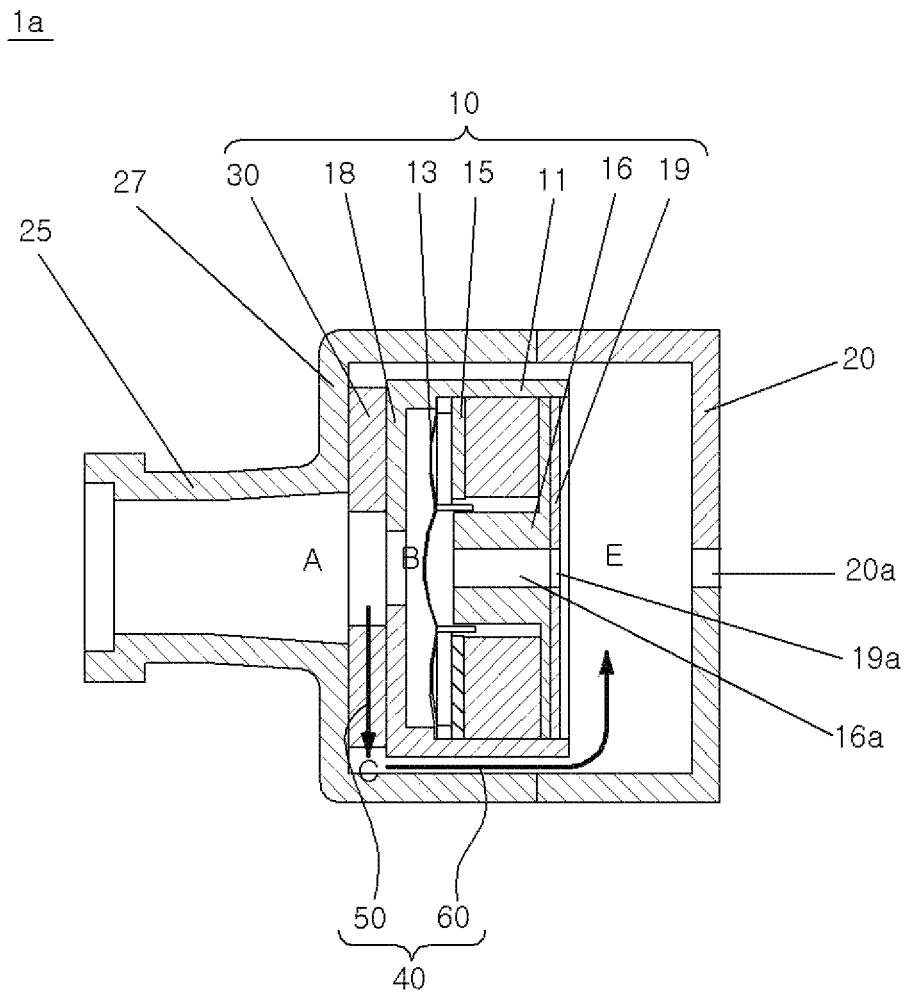
FIG. 6 is a cross-sectional view illustrating a first embodiment of the canal type earphone with a pressure equilibrium means according to the present invention.

First, a first embodiment 1*a* of the canal type earphone with a pressure equilibrium means according to the present invention includes a side air passage 50 through which air in the inside A of the tube 25 is discharged to the side surface C of the gasket 30, and a rear air passage 60 through which air in the side surface C of the gasket 30 is discharged to the rear E of the speaker unit 10, as shown in FIG. 6.

Figure 7:
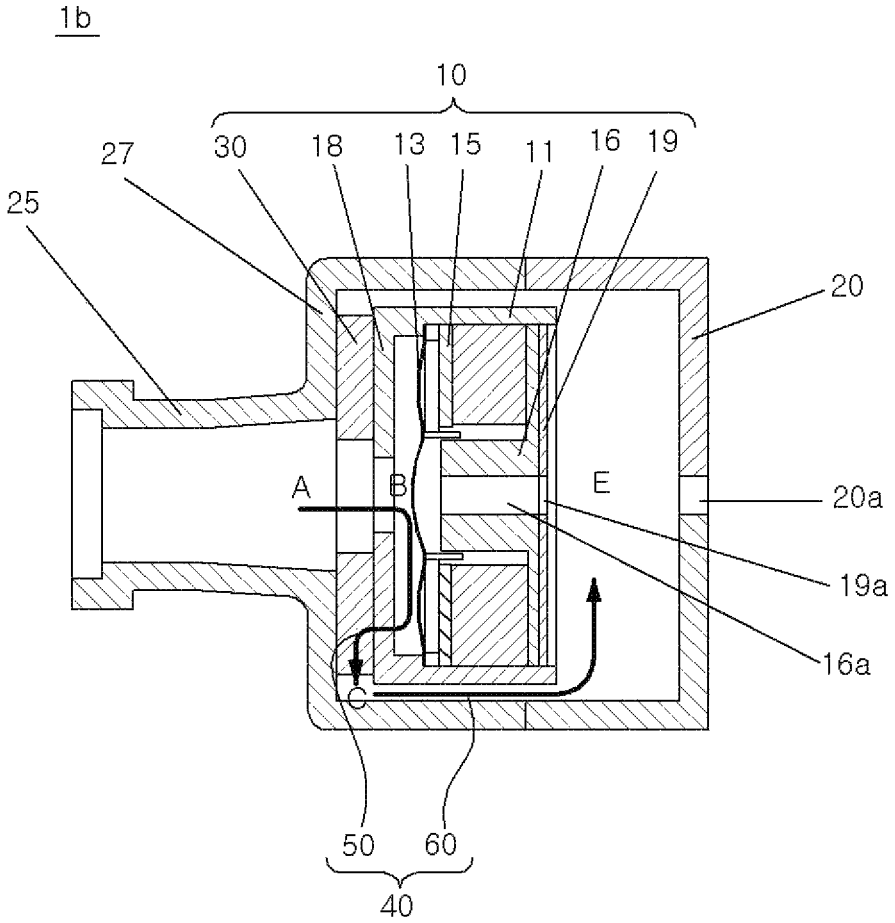
FIG. 7 is a cross-sectional view illustrating a second embodiment of the canal type earphone with a pressure equilibrium means according to the present invention.

As shown in FIG. 7, a second embodiment 1*b* of the canal type earphone with a pressure equilibrium means according to the present invention includes a side air passage 50 through which air in the inside A of the tube 25 is introduced to the inside B of the speaker unit 10 and air in the inside B of the speaker unit 10 is discharged to the side surface C of the gasket 30, and a rear air passage 60 through which air in the side surface C of the gasket 30 is discharged to the rear E of the speaker unit 10.

Figure 8:
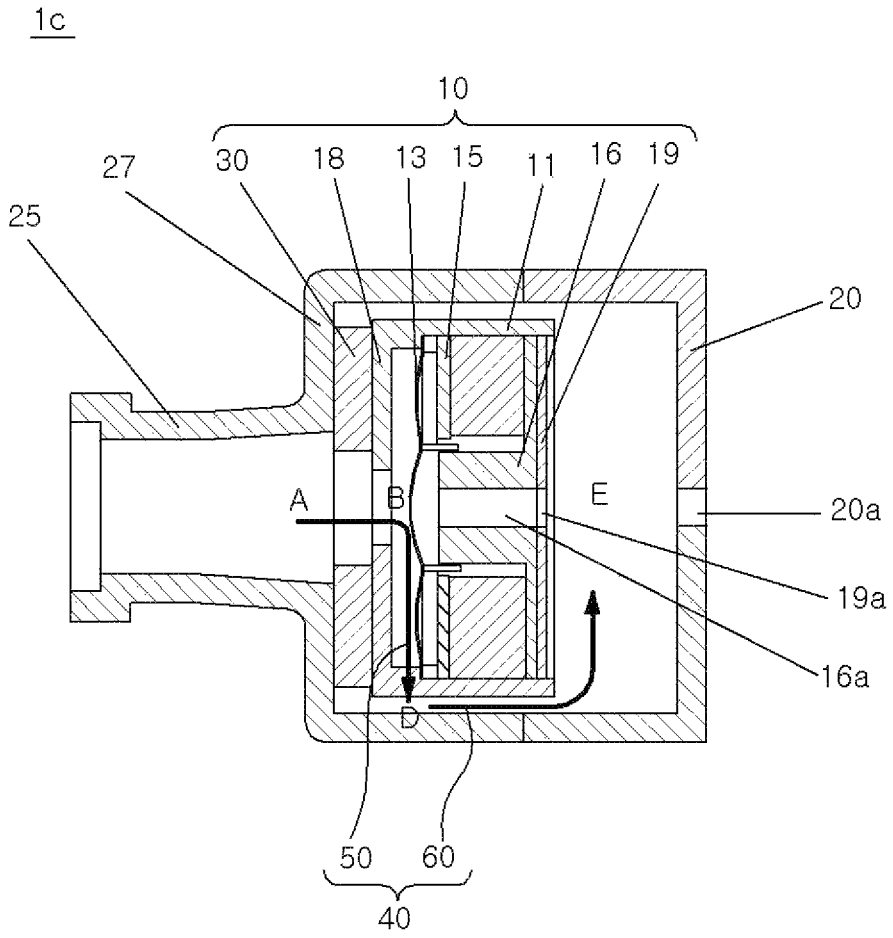
FIG. 8 is a cross-sectional view illustrating a third embodiment of the canal type earphone with a pressure equilibrium means according to the present invention.

As shown in FIG. 8, a third embodiment 1*c* of the canal type earphone with a pressure equilibrium means according to the present invention includes a side air passage 50 through which air in the inside A of the tube 25 is introduced to the inside B of the speaker unit 10 and air in the inside B of the speaker unit 10 is discharged to the side surface D of the speaker unit 10, and a rear air passage 60 through which air in the side surface D of the speaker unit 10 is discharged to the rear E of the speaker unit 10.

Figure 9:
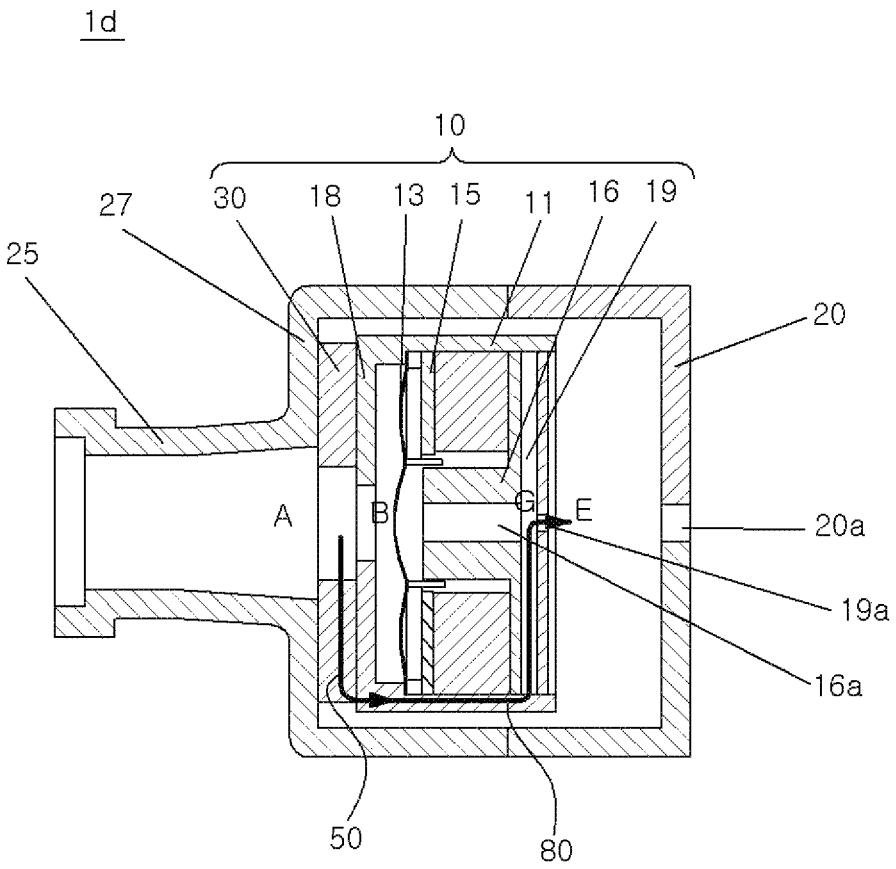
FIG. 9 is a cross-sectional view illustrating a fourth embodiment of the canal type earphone with a pressure equilibrium means according to the present invention.

As shown in FIG. 9, a fourth embodiment 1*d* of the canal type earphone with a pressure equilibrium means according to the present invention includes a side air passage 50 through which air in the inside A of the tube 25 is introduced to the inside B of the speaker unit 10, and an inside rear air passage 70 through which air in the inside B of the speaker unit 10 is discharged to the clearance G between the bracket and the yoke 16 of the speaker unit 10 and is then discharged to the rear E of speaker unit 10 through the through-hole 19*a* formed on the bracket 19.

Figure 10:
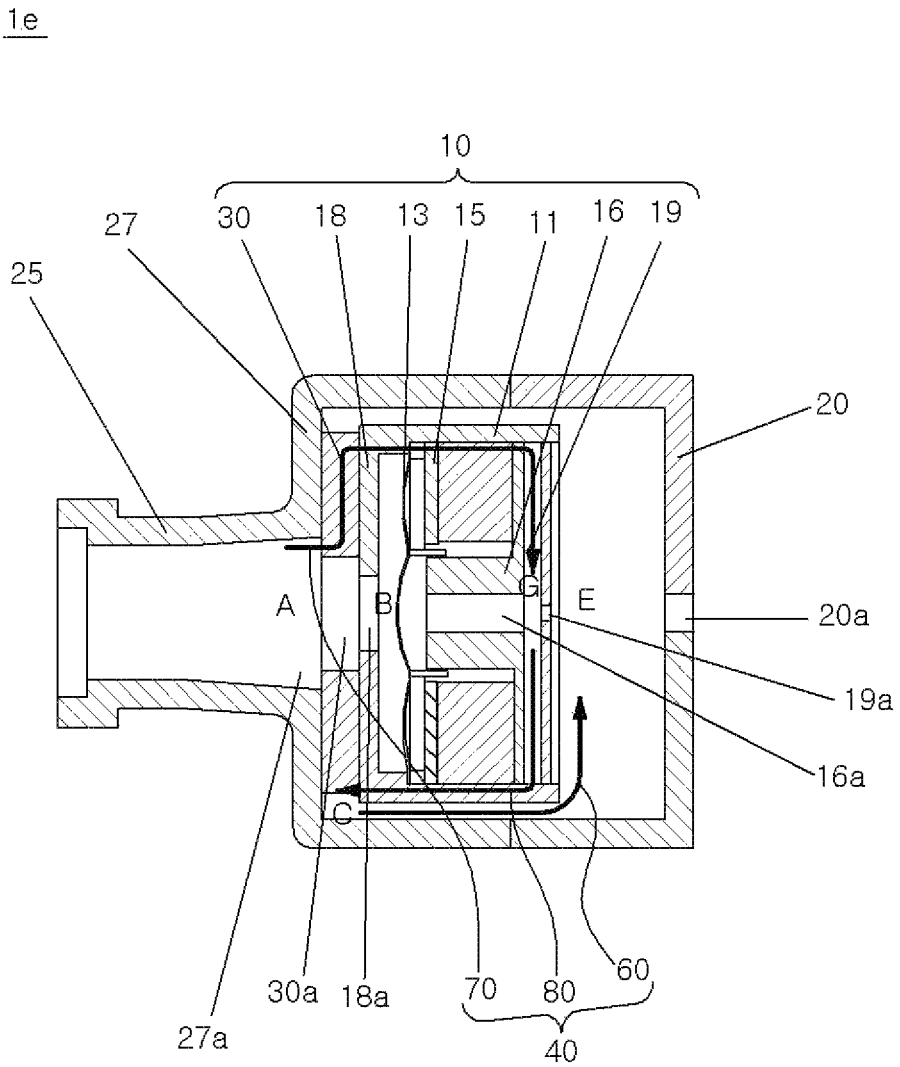
FIG. 10 is a cross-sectional view illustrating a fifth embodiment of the canal type earphone with a pressure equilibrium means according to the present invention.

As shown in FIG. 10, a fifth embodiment 1*e* of the canal type earphone with a pressure equilibrium means according to the present invention includes a side air passage 50 through which air in the inside A of the tube 25 is discharged to the back surface of the gasket 30, an inside rear air passage 70 through which air in the back surface of the gasket 30 is discharged to the clearance G between the bracket 19 and the yoke 16 of the speaker unit 10, an inside front air passage 80 through which air in the clearance G between the bracket 19 and the yoke 16 of the speaker unit 10 is discharged to the side surface C of the gasket 30, and a rear air passage 60 through which air in the side surface C of the gasket 30 is discharged to the rear E of the speaker unit 10.

Hereinafter, various embodiments of the side air passage and the rear air passage according to the present invention will be described.

Figure 11:
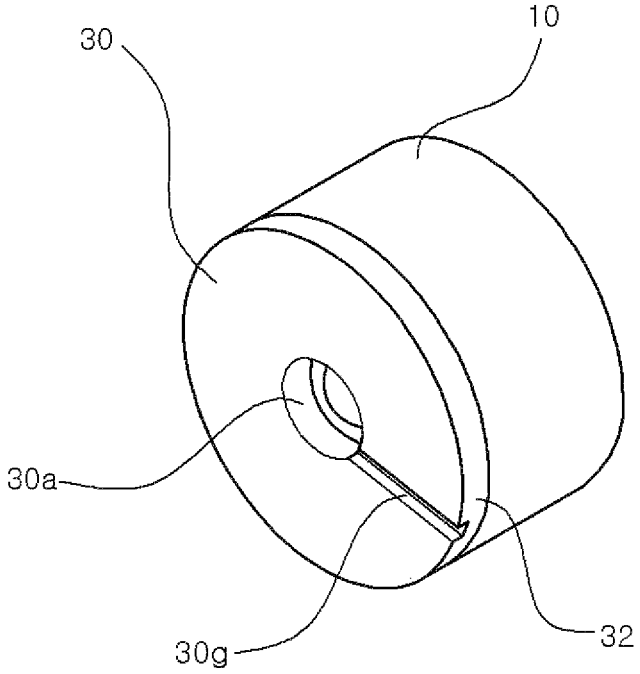
FIGS. 11 to 19 are views illustrating various embodiments of a side air passage according to the present invention.

First, FIG. 11 shows a first embodiment 51 of the side air passage according to the present invention. As shown in the drawing, a first side air passage 51 is configured of a vent groove 30*g* formed on the front or back surface of the gasket 30. The vent groove 30*g* formed on the gasket 30 has a predetermined depth. The vent groove 30*g* is connected, at one end thereof, to a through-hole 30*a* formed at the center of the gasket 30 while being connected, at the other end thereof, to an edge 32 of the gasket 30. Accordingly, air in the inside A of the tube 25 is discharged to the outside C of the edge 32 of the gasket 30 through the through-hole 30*a* formed at the center of the gasket 30 and the vent groove 30*g* formed on the front or back surface of the gasket 30.

Figure 12:
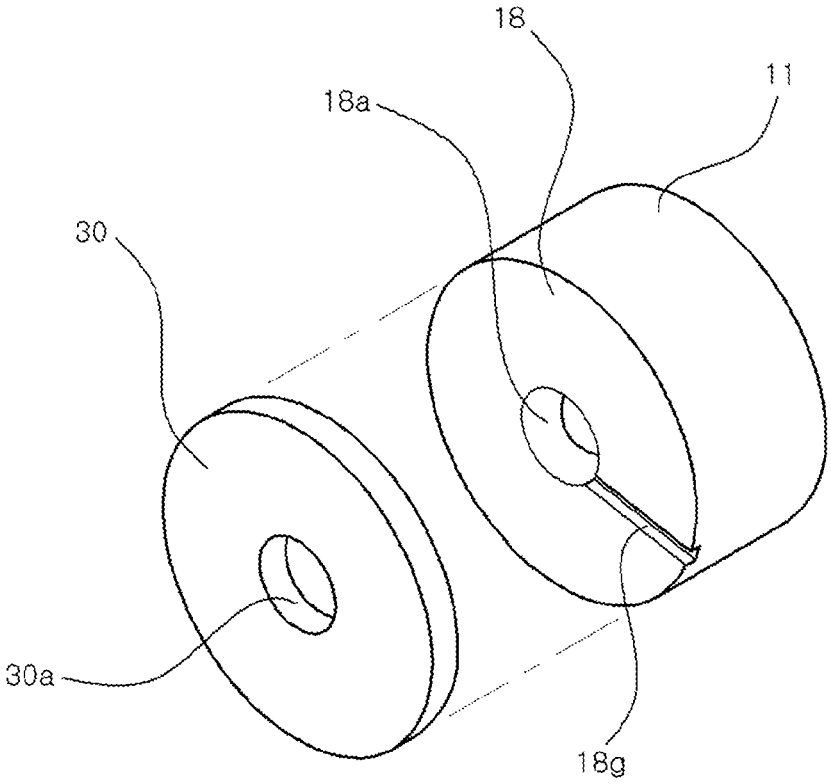

Next, FIG. 12 shows a second embodiment 52 of the side air passage. As shown in the drawing, a second side air passage 52 is configured of a vent groove 18*g* formed on the front surface of the cover 18. The vent groove 18*g* formed on the cover 18 has a predetermined depth. The vent groove 18*g* is connected, at one end thereof, to a through-hole 18*a* formed at the center of the cover 18 while being connected, at the other end thereof, to a side surface of the cover 18. Accordingly, air in the inside A of the tube 25 is discharged to the side surface C of the cover 18 through the through-hole 18*a* formed at the center of the cover 18 and the vent groove 18*g* formed on the front surface of the cover 18.

Figure 13:
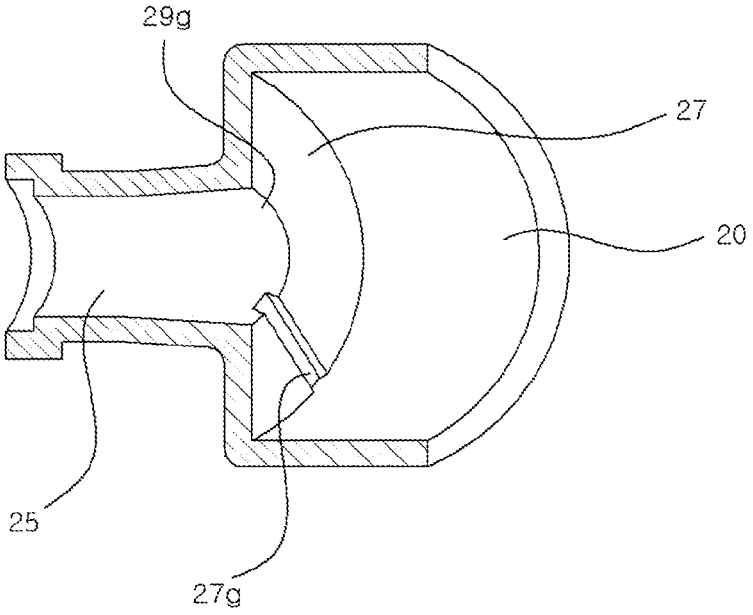

FIG. 13 shows a third embodiment 53 of the side air passage. As shown in the drawing, a third side air passage 53 is configured of a vent groove 27*g* formed on the rear surface of the front surface plate 27 of the housing 20. A through-hole 27*a* connected to the tube 25 is formed at the center of the front surface plate 27. The vent groove 27*g* formed on the front surface plate 27 has a predetermined depth. The vent groove 27*g* is connected, at one end thereof, to the through-hole 27*a* formed at the center of the front surface plate 27 while being connected, at the other end thereof, to an edge of the front surface plate 27. Accordingly, air in the inside A of the tube 25 is discharged to the edge of the front surface plate 27 through the through-hole 27*a* formed at the center of the front surface plate 27 and the vent groove 27*g* radially formed on the rear surface of the front surface plate 27.

Figure 14:
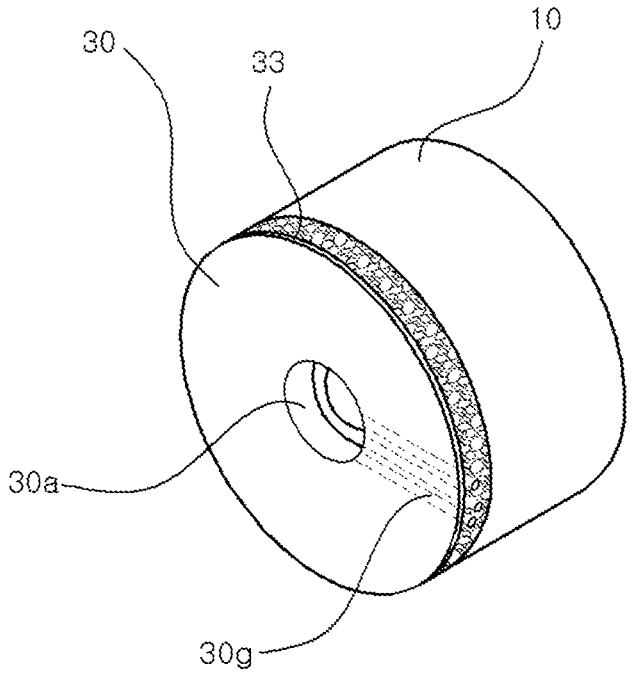

FIG. 14 shows a fourth embodiment 54 of the side air passage. As shown in the drawing, a fourth side air passage is configured of a plurality of vent holes 30*h* formed within the gasket 30. The gasket 30 is made of a porous material and has a plurality of apertures formed therein. The vent holes 30*h* are formed by connection of the plural apertures. Each of the vent hole 30*h* is connected, at one end thereof, to a through-hole 30*a* formed at the center of the gasket 30 while being connected, at the other end thereof, to an edge of the gasket 30. In this case, a reinforcement film is may be attached to the front surface of the gasket 30. Accordingly, air in the inside A of the tube 25 may be discharged to the side surface of the gasket 30 through the plural vent holes 30*h* formed on the gasket 30.

Figure 15:
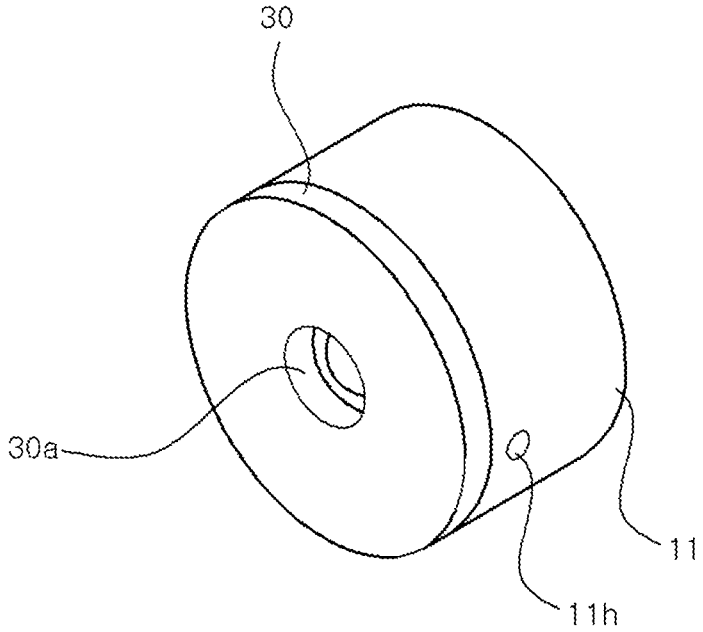

FIG. 15 shows a fifth embodiment 55 of the side air passage. As shown in the drawing, a fifth side air passage 55 is configured of a vent hole 11*h* formed on the side surface of the frame 11 of the speaker unit 10. The vent hole 11*h* is formed between the cover 18 and the vibration plate 13. Accordingly, air in the inside A of the tube 25 may be introduced to the inside of the speaker unit 10 through the through-hole 18*a* formed on the cover 18 and air in the inside B of the speaker unit 10 may be discharged to the side surface D of the speaker unit 10 through the vent hole 11*h* formed on the frame 11.

Figure 16:
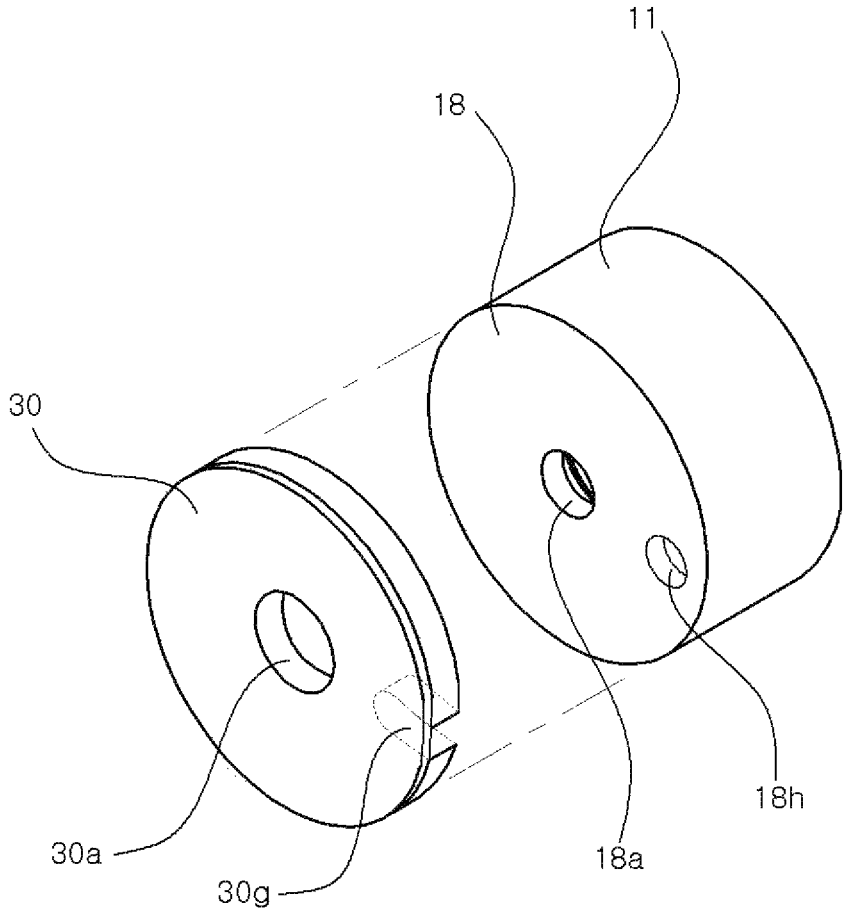

FIG. 16 shows a sixth embodiment 56 of the side air passage. As shown in the drawing, a sixth side air passage 56 is configured of a vent hole 18*h* formed at one side of the cover 18 of the speaker unit 10 and a vent groove 30*g* formed on the lower surface of the gasket 30. The vent hole 18*h* is formed at a position spaced apart from a through-hole 18*a* formed at the center of the cover 18 by a predetermined distance. The vent groove 30*g* is formed of a predetermined depth on the lower surface of the gasket 30. The vent groove 30*g* is connected, at one end thereof, to the vent hole 18*h* while being connected, at the other end thereof, to an edge 32 of the gasket 30. Accordingly, air in the inside A of the tube 25 may be introduced to the inside B of the speaker unit 10 through the through-hole 18*a* formed on the cover 18, air in the inside B of the speaker unit 10 may be discharged to the vent groove 30*g* formed on the back surface of the gasket 30 through the vent hole 18*h* formed on the cover 18, and air discharged to the back surface of the gasket 30 may be discharged to the edge 32 of the gasket 30 through the vent groove 30*g*.

Figure 17:
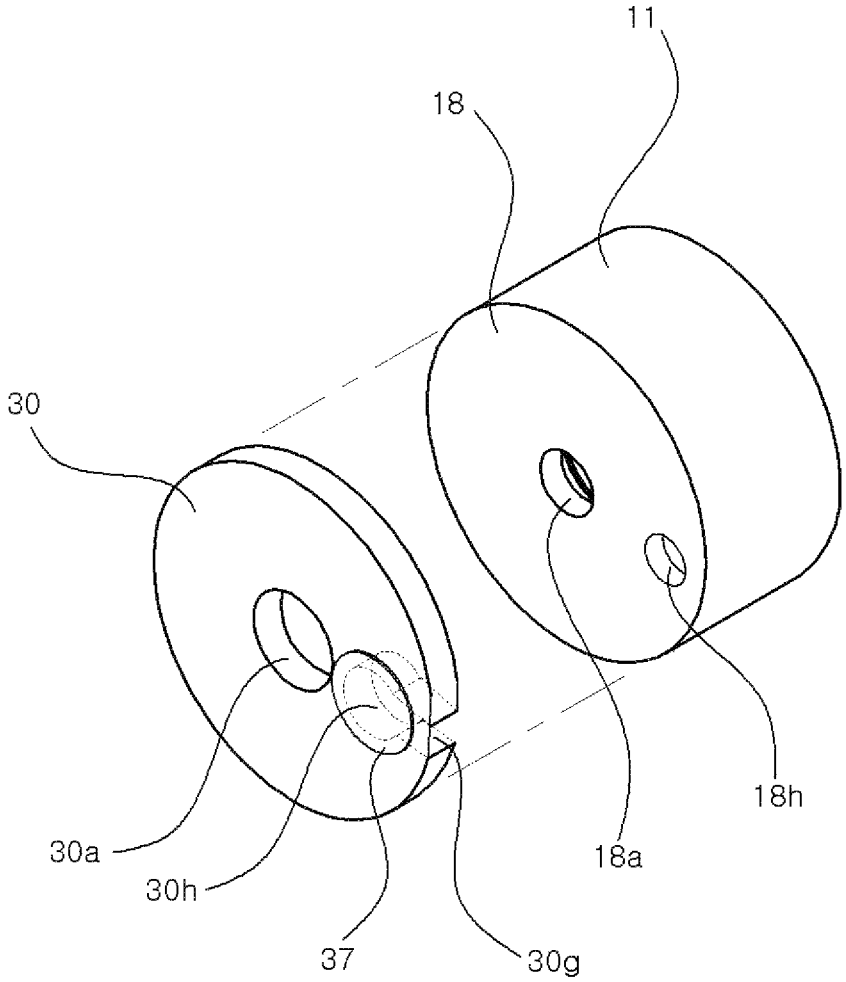

FIG. 17 shows a seventh embodiment 57 of the side air passage. As shown in the drawing, a seventh side air passage 57 is configured of a first vent hole 18*h* formed at one side of the cover 18, a second vent hole 30*h* formed on the gasket 30 to correspond to the first vent hole 18*h*, and a vent groove 30*g* formed on the lower surface of the gasket 30 to be connected to the second vent hole 30*h*. The first vent hole 18*h* is formed at a position spaced apart from a through-hole 18*a* formed at the center of the cover 18 by a predetermined distance, and the second vent hole 30*h* is formed at a position corresponding to the first vent hole 18*h*. In this case, the second vent hole 30*h* is formed to have a diameter greater than the first vent hole 18*h*. A damping film 37 is attached to the upper surface of the second vent hole 30*h* so as to close the opened surface of the second vent hole 30*h*. The vent groove 30*g* has a predetermined depth. The vent groove 30*g* is connected, at one end thereof, to the first vent hole 18*h* while being connected, at the other end thereof, to an edge 32 of the gasket 30. Accordingly, air in the inside A of the tube 25 may be introduced to the inside B of the speaker unit 10 through the through-hole 18*a* formed on the cover 18, air in the inside B of the speaker unit 10 may be discharged to the second vent hole 30*h* formed on the gasket 30 through the first vent hole 18*h* formed on the cover 18, and air discharged to the second vent hole 30*h* of the gasket 30 may be discharged to the edge 32 of the gasket 30 through the vent groove 30*g* formed on the gasket 30. As such, the present invention may adjust a discharge amount of air discharged through the air passage by adjusting the size of the diameter of the vent hole 30*h* formed on the gasket 30 and changing a material of the damping film 37 attached to the vent hole 30*h*.

Figure 18:
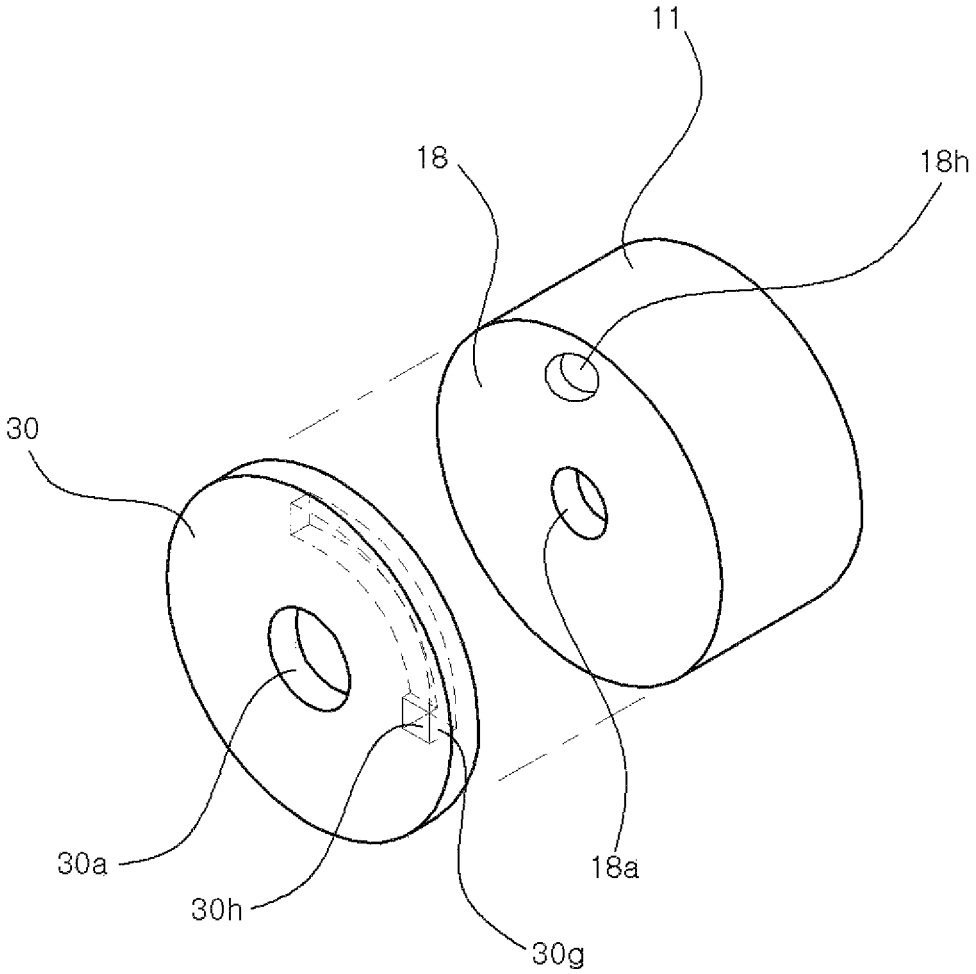

FIG. 18 shows an eighth embodiment 58 of the side air passage. As shown in the drawing, an eighth side air passage 58 is configured of a first vent hole 30*h* formed at one side of the gasket 30, a vent groove 30*g* formed on the back surface of the gasket 30 to be connected to the first vent hole 30*h*, and a second vent hole 18*h* formed on the cover 18 to be connected to the vent groove 30*g*. The first vent hole 30*h* formed on the gasket 30 is formed at a position spaced apart from a through-hole 18*a* formed at the center of the cover 18 by a predetermined distance. The vent groove 30*g* formed on the back surface of the gasket 30 has a predetermined depth. The vent groove 30*g* is connected, at one end thereof, to the first vent hole 30*h* while being connected, at the other end thereof, to the second vent hole 18*h*. Accordingly, air in the inside A of the tube 25 is discharged to the back surface of the gasket 30 through the first vent hole 30*h* formed on the gasket 30, and air discharged to the back surface of the gasket 30 is discharged to the inside of the speaker unit 10 through the vent groove 30*g* formed on the back surface of the gasket 30 and the second vent hole 18*h* formed on the cover 18.

Figure 19:
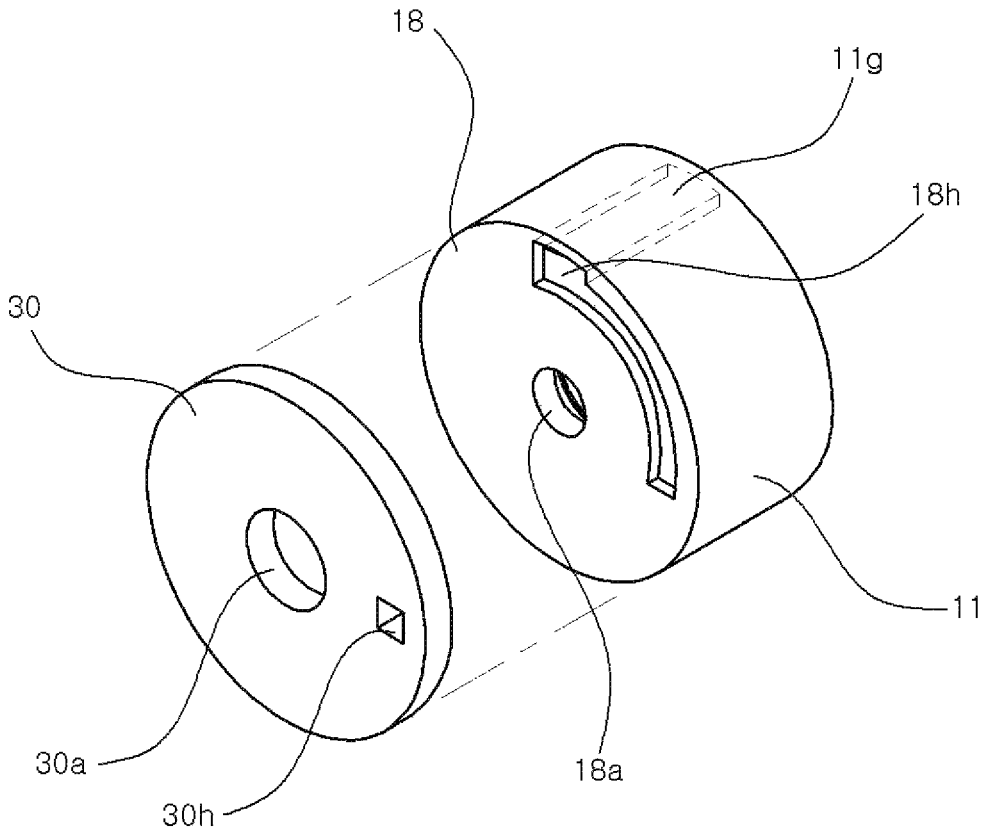

FIG. 19 shows a ninth embodiment 59 of the side air passage. As shown in the drawing, a ninth side air passage 59 is configured of a first vent hole 30*h* formed at one side of the gasket 30, a vent groove 18*g* formed on the front surface of the cover 18 to be connected to the first vent hole 30*h*, and a second vent hole 18*h* formed on the cover 18 to be connected to the vent groove 18*g*. The first vent hole 30*h* formed on the gasket 30 is formed at a position spaced apart from a through-hole 18*a* formed at the center of the cover 18 by a predetermined distance. The vent groove 18*g* formed on the cover 18 has a predetermined depth. The vent groove 18*g* is connected, at one end thereof, to the first vent hole 30*h* while being connected, at the other end thereof, to the second vent hole 18*h*. Accordingly, air in the inside A of the tube 25 is discharged to the front surface of the cover 18 through the first vent hole 30*h* formed on the gasket 30, and air discharged to the front surface of the cover 18 is discharged to the inside of the speaker unit 10 through the second vent hole 18*h* formed on the cover 18. Accordingly, air in the inside A of the tube 25 is discharged to the front surface of the cover 18 through the first vent hole 30*h* formed on the gasket 30, and air discharged to the front surface of the cover 18 is discharged to the inside of the speaker unit 10 through the vent hole 18*h* formed on the cover 18.

Figure 20:
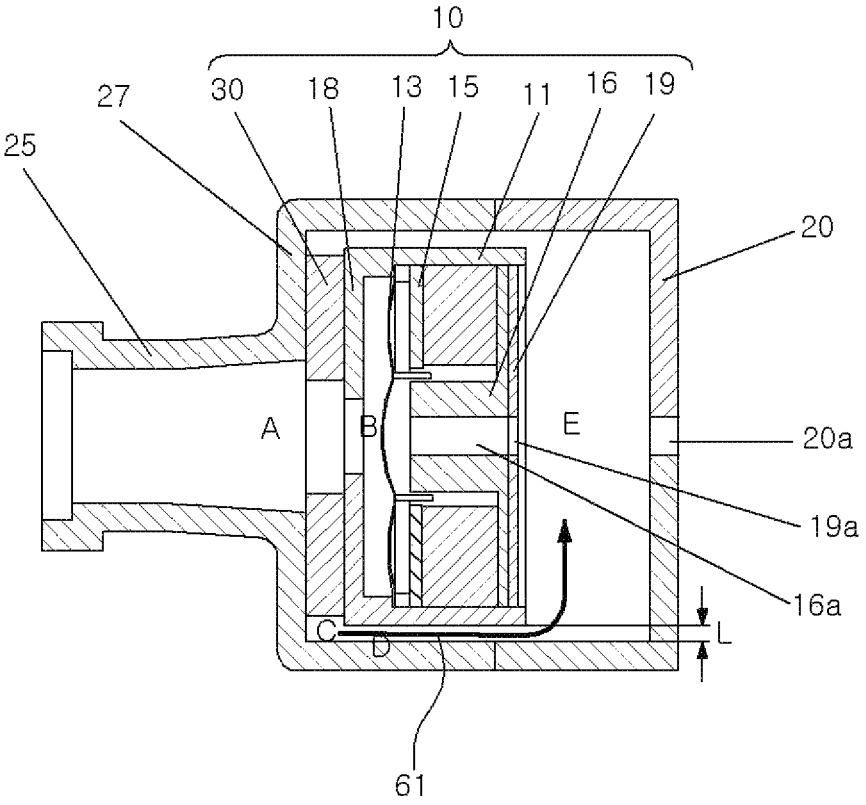
FIG. 20 is a cross-sectional view illustrating a first embodiment of a rear air passage according to the present invention.

FIG. 20 shows a first embodiment 61 of the rear air passage. As shown in the drawing, an inside rear air passage 61 is configured of a gap L formed between the inside surface of the housing 20 and the outside surface 11*a* of the speaker unit 20. In this case, the gap L may be configured by forming a protrusion having a predetermined height on the inside surface 21 of the housing 20 or the outside surface 11*a* of the speaker unit 20. Accordingly, air in the side surface C of the gasket 30 or the side surface D of the speaker unit 10 may be discharged to the rear E of the speaker unit 10 through the gap L.

Figure 21:
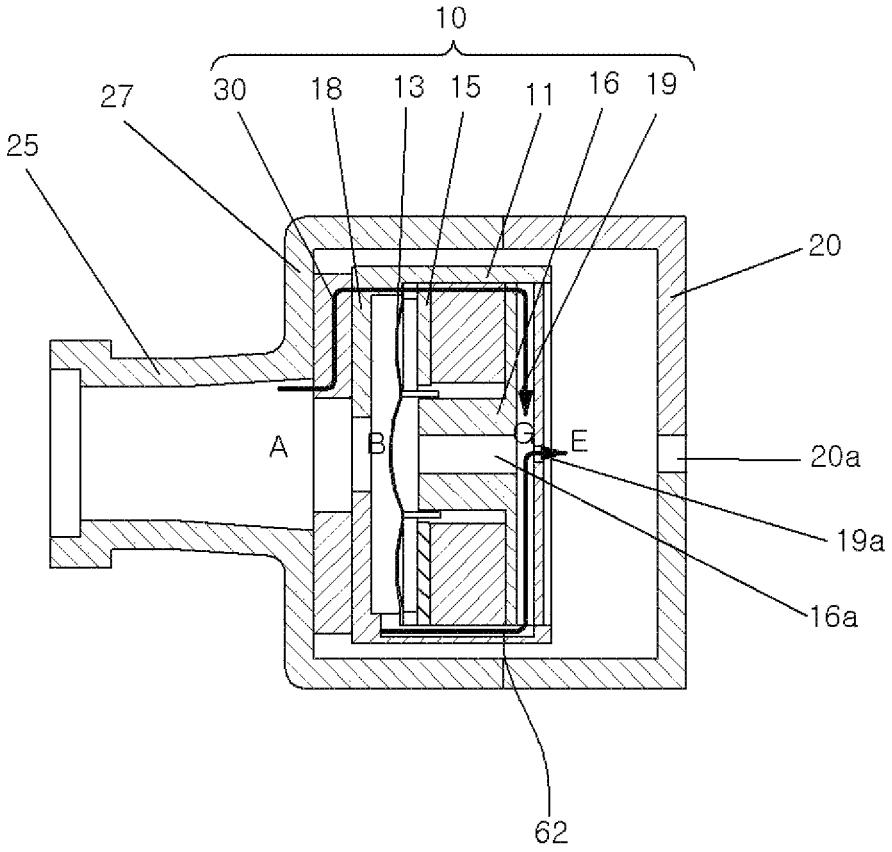
FIG. 21 is a cross-sectional view illustrating a second embodiment of the rear air passage according to the present invention.

FIG. 21 shows a second embodiment 62 of the rear air passage. As shown in the drawing, a rear air passage 62 is configured of a vent groove 11*g* formed on the inside surface 11*b* of the frame 11. The vent groove 11*g* has a predetermined depth. The vent groove 11*g* is connected, at one end thereof, between the cover 18 and the vibration plate 13 while being connected, at the other end thereof, between the yoke 16 and the bracket 19. Accordingly, air in the inside B of the speaker unit 10 may be discharged to the rear E of the speaker unit 10 along the vent groove 11*g* formed on the frame 11.

Figure 22:
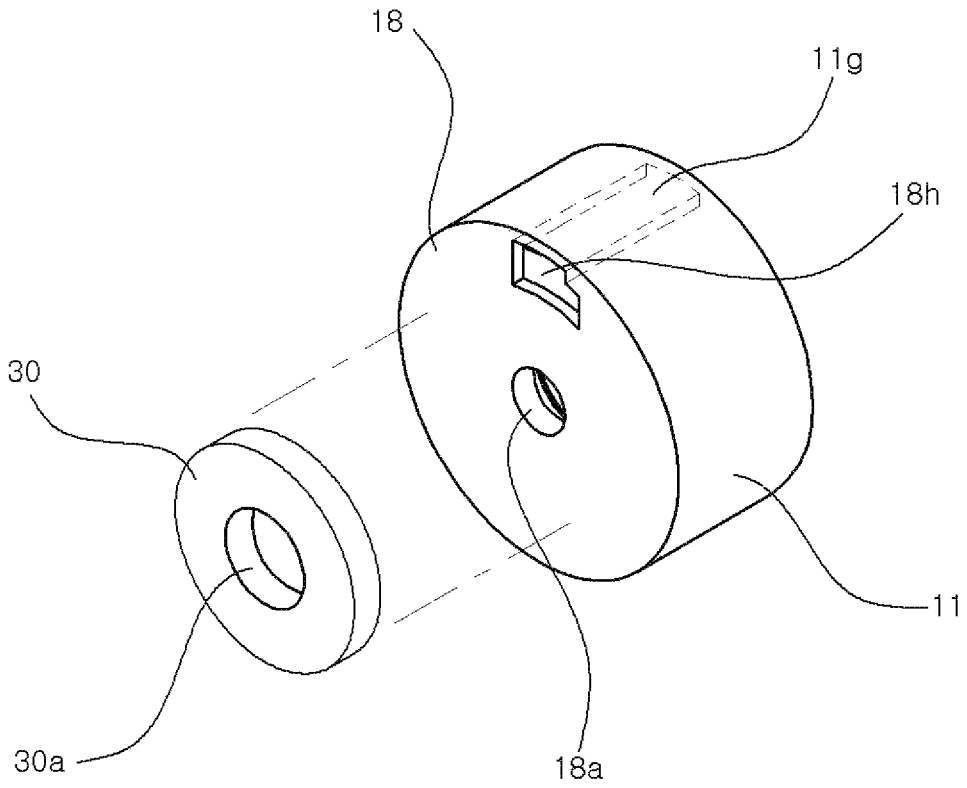
FIG. 22 is a cross-sectional view illustrating an inside rear air passage and an inside front air passage according to the present invention.

FIG. 22 shows the inside rear air passage 70 and the inside front air passage 80. As shown in the drawing, the inside rear air passage 70 and the inside front air passage 80 are configured of a vent hole 18*h* formed on the cover 18 and a vent groove 11*g* formed on the inside surface 11*b* of the frame 11. The vent groove 11*g* has a predetermined depth. The vent groove 11*g* is connected, at one end thereof, to the vent hole 18*h* formed on the cover 18 while being connected, at the other end thereof, between the yoke 16 and the bracket 19. Accordingly, air in the inside A of the tube 25 may be discharged to the inside B of the speaker unit 10 through the vent hole 18*h* formed on the cover 18, and air in the inside B of the speaker unit 10 may be discharged between the yoke 16 and the bracket 19 through the vent groove 11*g* formed on the frame 11. On the other hand, air between the yoke 16 and the bracket 19 may be discharged to the front B of the speaker unit 10 through the vent groove 11*g* formed on the frame 11 and the vent hole 18*h* formed on the cover 18.

Hereinafter, various embodiments of the canal type earphone with a pressure equilibrium means according to the present invention will be described in more detail.

Figure 23:
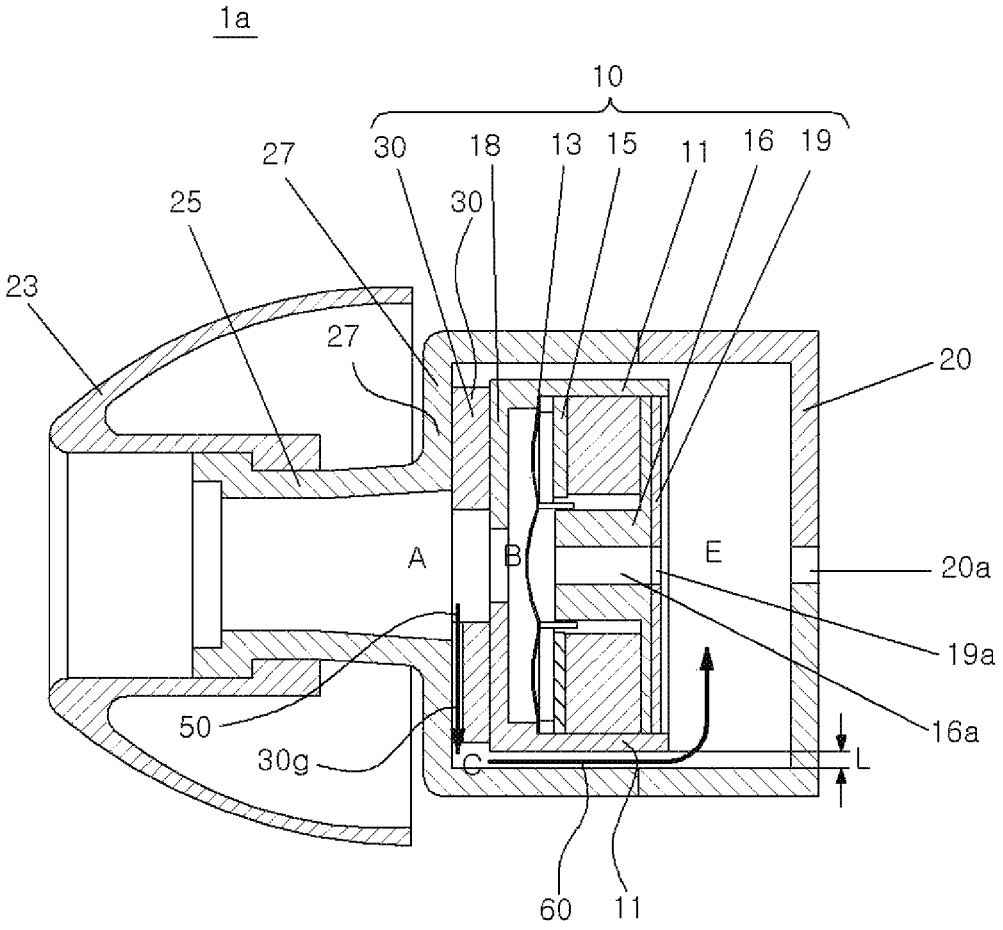
FIGS. 23 to 27 are cross-sectional views illustrating various embodiments of the canal type earphone with a pressure equilibrium means according to the present invention.

First, FIG. 23 shows a first embodiment 1*a* of the canal type earphone with a pressure equilibrium means according to the present invention. As shown in the drawing, the canal type earphone 1*a* according to the present invention mainly includes a speaker unit 10, a housing 20 receiving the speaker unit 10, and an earpiece 23 installed on an outer surface of a tube 25 which is integrally formed at the front of the housing 20.

The cylindrical tube 25 is integrally formed at the front of the housing 20. The earpiece 23 installed to the tube 25 may be formed to be inserted into a user's external auditory meatus. The housing 20 is formed integrally with a front surface plate 27 against which the speaker unit 10 is pressed, and is formed, at a center thereof, with a through-hole 27*a* connected with the tube 25.

The speaker unit 10 installed within the housing 20 includes a cylindrical frame 11, a magnetic circuit 12 installed within the frame 11, and a vibration plate 13 which vertically vibrates by magnetic force of the magnetic circuit 12. The frame 11 has a cylindrical shape. A cover 18 is installed on a front surface of the frame 11 and a bracket 19 is installed on a rear surface of the frame 11.

The cover 18 has a through-hole 18*a* formed at a center thereof so that sound generated by the vibration plate 13 is emitted forward through the through-hole 18*a*. The bracket 19 has a through-hole 19*a* formed at a center thereof so that sound generated by the vibration plate 13 is emitted rearward through the through-hole 19*a*.

A gasket 30 is installed on a front surface of the cover 18. The gasket 30 has a through-hole 30*a* formed at a center thereof, and is formed of a doughnut shape. A vent groove 30*g* is formed on a front surface of the gasket 30. The vent groove 30*g* forms a side air passage through which air in the inside A of the tube 25 is discharged to a side surface of the gasket 30. The vent groove 30*g* has a predetermined depth. The vent groove 30*g* is connected, at one end thereof, to the through-hole 30*a* while being connected, at the other end thereof, to an edge 32 of the gasket 30.

A uniform gap L is formed between an inside surface 20*a* of the housing 20 and an outside surface 10*a* of the speaker unit 10. The gap L forms a rear air passage through which air in the side surface C of the gasket 30 is discharged rearward of the speaker unit 10. In this case, the gap L may be configured by forming a protrusion having a predetermined height on the inside surface 20*a* of the housing 20 or the outside surface 10*a* of the speaker unit 20.

Accordingly, air in the inside A of the tube 25 may be discharged to the side surface C of the gasket 30 through the vent hole 30*g* formed on the gasket 30, and air in the side surface C of the gasket 30 may be discharged to the rear E of the speaker unit 10 through the gap L.

Figure 24:
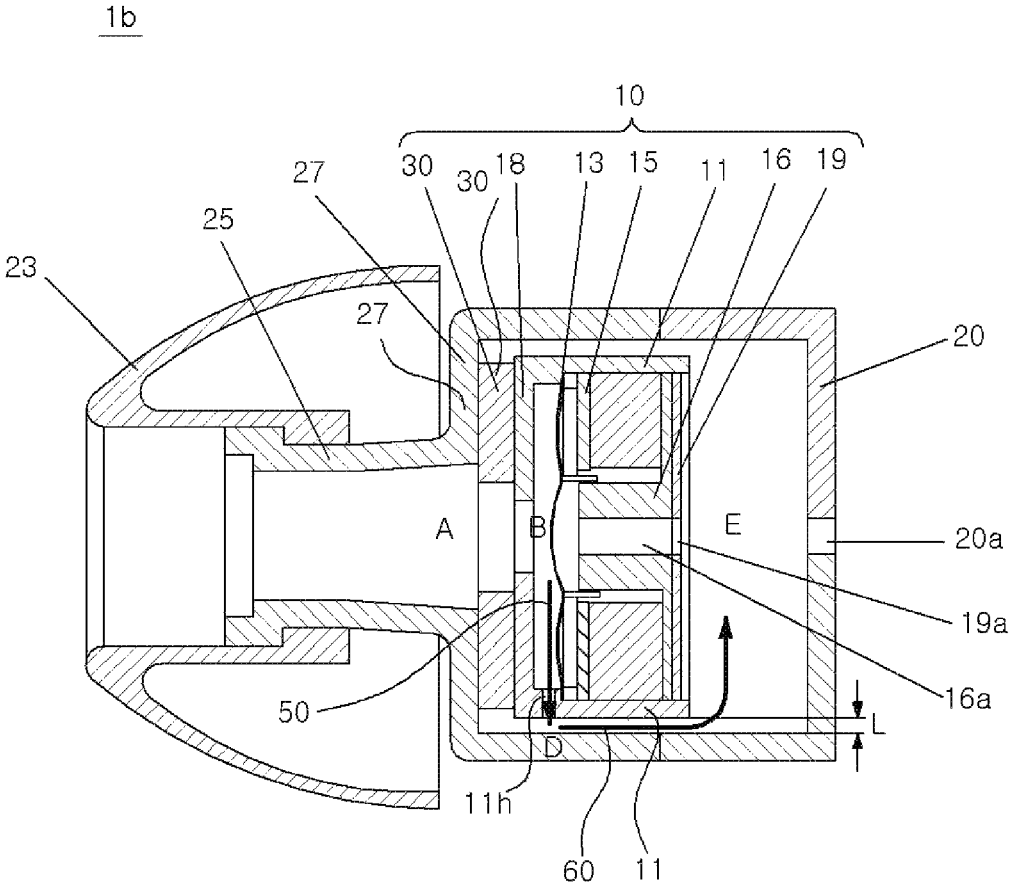

FIG. 24 shows a second embodiment 1*b* of the canal type earphone with a pressure equilibrium means according to the present invention. The same reference numbers will be used with respect to parts similar to those of the above-mentioned embodiment, and no detailed description will be given thereof. As shown in the drawing, the canal type earphone 1*b* according to the present invention has a vent hole 11*h* formed on the side surface of the frame 11. The vent hole 11*h* forms a side air passage through which air in the inside B of the speaker unit 10 is discharged to the side surface D of the speaker unit 10. In this case, the vent hole 11*h* is formed between the cover 18 and the vibration plate 13.

A uniform gap L is formed between an inside surface 20*a* of the housing 20 and an outside surface 10*a* of the speaker unit 10. The gap L forms a rear air passage through which air in the side surface C of the gasket 30 is discharged to the rear E of the speaker unit 10.

Accordingly, air in the inside A of the tube 25 is introduced to the inside B of the speaker unit 10 through the through-hole 18*a* formed on the cover 18, and air in the inside B of the speaker unit 10 is discharged to the side surface D of the speaker unit 10 through the vent hole 11*h* formed on the frame 11. Air in the side surface D of the speaker unit 10 may be discharged to the rear E of the speaker unit 10 through the gap L.

Figure 25:
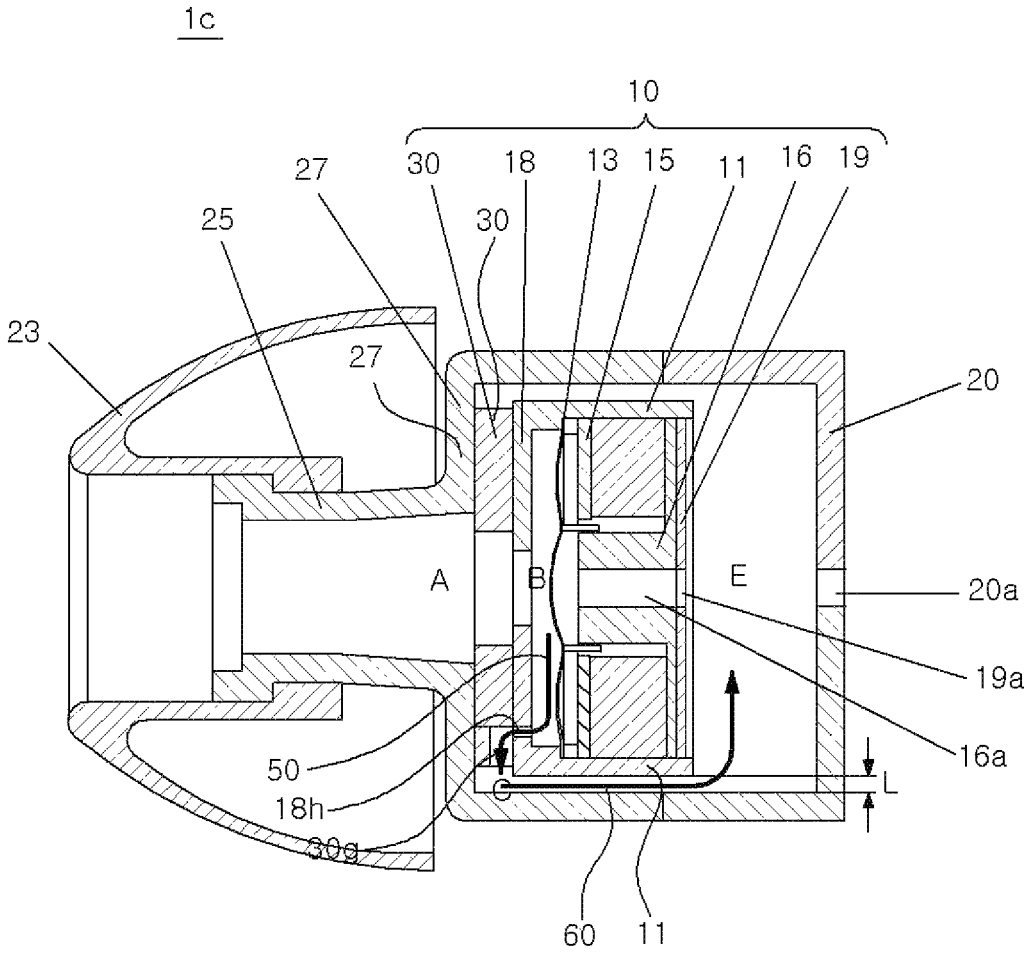

FIG. 25 shows a third embodiment 1*c* of the canal type earphone with a pressure equilibrium means according to the present invention. As shown in the drawing, the canal type earphone 1*c* according to the present invention has a vent hole 18*h* formed on the cover 18 and a vent groove 30*g* formed on the rear surface of the gasket 30 to be connected to the vent hole 18*h*.

The vent hole 18*h* formed on the cover 18 and the vent groove 30*g* formed on the rear surface of the gasket 30 form a side air passage 50 through which air in the inside B of the speaker unit 10 is discharged to the side surface C of the gasket 30. The vent hole 18*h* is formed at a position spaced apart from a through-hole 18*a* formed at the center of the cover 18 by a predetermined distance. The vent groove 30*g* has a predetermined depth. The vent groove 30*g* is connected, at one end thereof, to the vent hole 18*h* while being connected, at the other end thereof, to an edge 32 of the gasket 30.

A uniform gap L is formed between an inside surface 20*a* of the housing 20 and an outside surface 10*a* of the speaker unit 10. The gap L forms a rear air passage through which air in the side surface C of the gasket 30 is discharged to the rear E of the speaker unit 10.

Accordingly, air in the inside A of the tube 25 is introduced to the inside B of the speaker unit 10 through the through-hole 18*a* formed at the center of the cover 18, air in the inside B of the speaker unit 10 is discharged to the back surface of the gasket 30 through the vent hole 11*h* formed at one side of the cover 18, and air discharged to the back surface of the gasket 30 is discharged to the edge 32 of the gasket 30 through the vent groove 30*g*. Air in the side surface D of the speaker unit 10 may be discharged to the rear E of the speaker unit 10 through the gap L.

Figure 26:
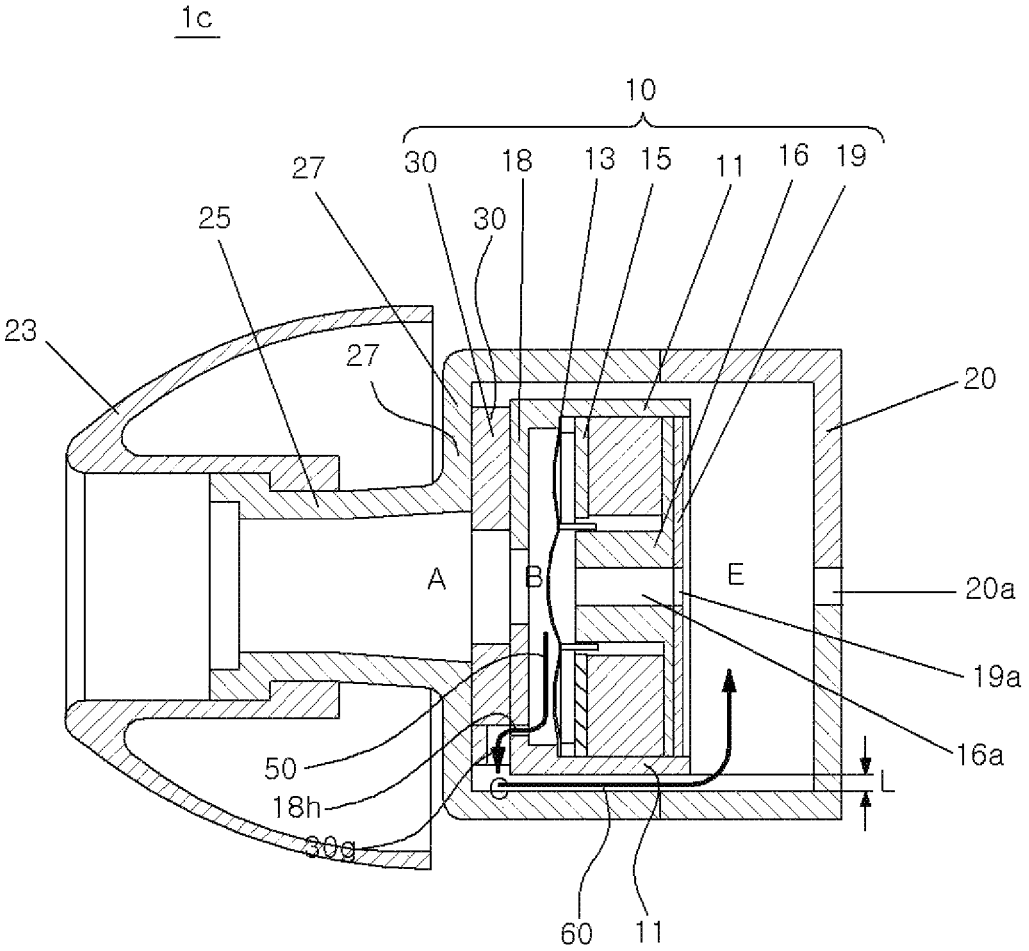

FIG. 26 shows a fourth embodiment 1*d* of the canal type earphone with a pressure equilibrium means according to the present invention. As shown in the drawing, the canal type earphone 1*d* according to the present invention has a through-hole 18*a* formed at the center of the cover 18. The through-hole 18*a* serves as a side air passage through which air in the inside of the tube 25 is introduced to the inside of the speaker unit 10.

A vent groove 11*g* is formed on the inside surface 11*b* of the frame 11. The vent groove 11*g* has a predetermined depth. The vent groove 11*g* is connected, at one end thereof, between the cover 18 and the vibration plate 13 while being connected, at the other end thereof, between the yoke 16 and the bracket 19. The vent groove 11*g* forms a rear air passage through which air in the inside B of the speaker unit 10 is discharged to the rear of the speaker unit 10.

Accordingly, air in the inside A of the tube 25 is introduced to the inside B of the speaker unit 10 through the through-hole 18*a* formed on the cover 18, air in the inside B of the speaker unit 10 is discharged between the yoke 16 and the bracket 19 through the vent groove 11*g* formed on the inside surface 11*b* of the frame 11, and air between the yoke 16 and the bracket 19 is discharged to the rear of the speaker unit 10 through the through-hole 19*a* formed on the bracket 19.

Figure 27:
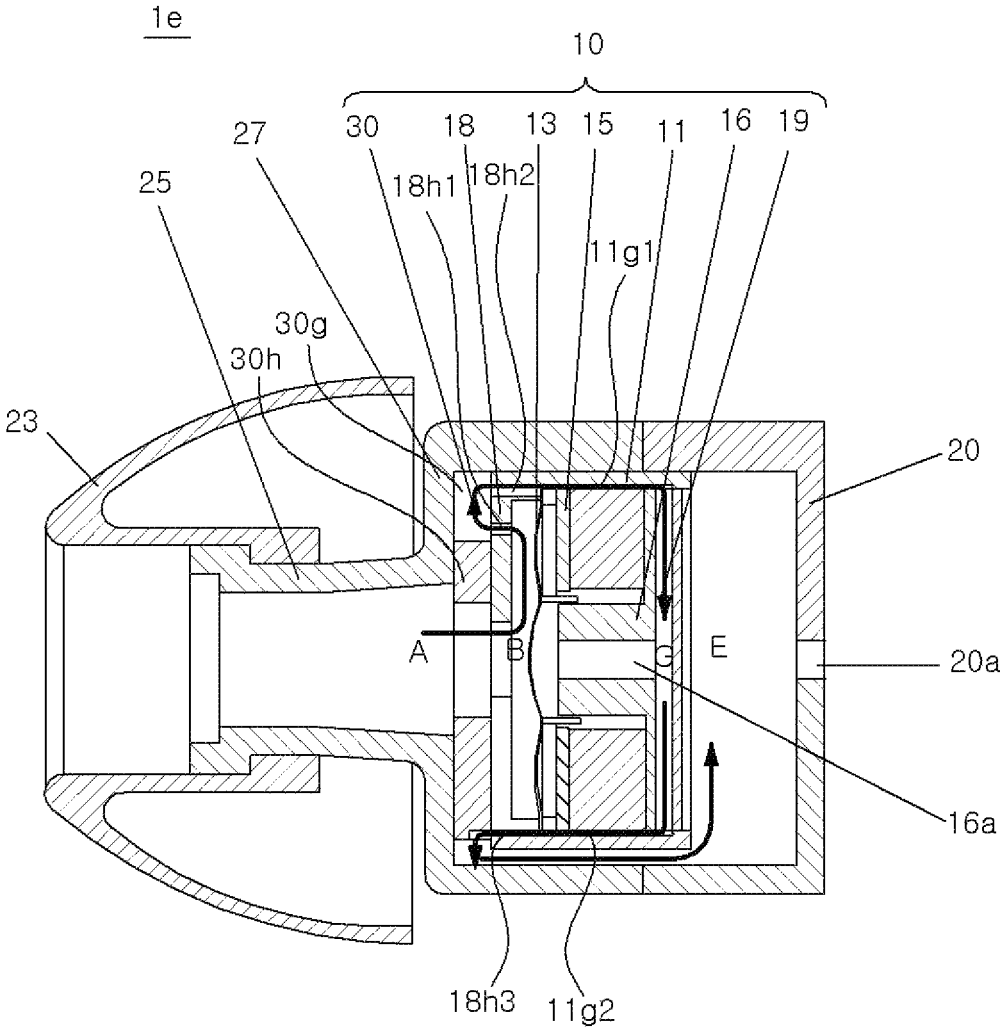

FIG. 27 shows a fifth embodiment 1*e* of the canal type earphone with a pressure equilibrium means according to the present invention. As shown in the drawing, the canal type earphone 1*e* according to the present invention has a first vent hole 18*h*1 formed at one side of the cover 18. The first vent hole 18*h*1 formed on the cover 18 forms a side air passage through which air in the inside of speaker unit 10 is discharged to the front of the speaker unit 10.

A first vent groove 11*g*1 is formed at one side on the inside surface 11*b* of the frame 11. The first vent groove 11*g*1 has a predetermined depth. The first vent groove 11*g*1 is connected, at one end thereof, to a second vent hole 18*h*2 passing through the cover 18 while being connected, at the other end thereof, to the clearance G between the yoke 16 and the bracket 19. The first vent groove high forms an inside rear air passage through which air in the inside B of the speaker unit 10 is discharged between the yoke 16 and the bracket 19.

A second vent groove 11*g*2 is formed at the other side on the inside surface 11*b* of the frame 11. The second vent groove 11*g*2 has a predetermined depth. The second vent groove 11*g*2 is connected, at one end thereof, to the clearance G between the yoke 16 and the bracket 19 while being connected, at the other end thereof, to a third vent hole 18*h*3 formed at the cover 18. Accordingly, the second vent groove 11*g*2 forms an inside front air passage 80 through which air in the clearance G between the yoke 16 and the bracket 19 is discharged to the side surface C of the gasket 30 or the side surface D of the speaker unit 10.

A uniform gap L is formed between an inside surface 20*a* of the housing 20 and an outside surface 10*a* of the speaker unit 10. The gap L forms a rear air passage through which air in the side surface C of the gasket 30 or the side surface D of the speaker unit 10 is discharged to the rear E of the speaker unit 10.

Accordingly, air in the inside A of the tube 25 may be introduced to the inside B of the speaker unit 10 through the vent hole 18*h*1 formed on the cover 18, air in the inside B of the speaker unit 10 may be discharged between the yoke 16 and the bracket 19 through the first vent groove 11*g*1 formed on the frame 11, air between the yoke 16 and the bracket 19 may be discharged to the side surface C of the gasket 30 or the side surface D of the speaker unit 10 through the second vent groove 11*g*2 formed on the frame 11 and the vent hole 18*h*2 formed on the cover 18, and air in the side surface C of the gasket 30 or the side surface D of the speaker unit 10 may be discharged to the rear E of the speaker unit 10 through the gap L.

As described above, the canal type earphone with a pressure equilibrium means according to the present invention may discharge air within the tube or air within the speaker unit to the rear of the speaker unit through the side air passage and the rear air passage so that the pressure in the user's external auditory meatus is equilibrated with the outside pressure. In particular, the pressure equilibrium means according to the present invention may minutely adjust a discharge amount of air by lengthways extending the length of the air passage and bending the air passage in a direction of degrees. In addition, the pressure equilibrium means according to the present invention may be installed within the speaker unit to prevent the air passage from being closed by the earpiece or the external auditory meatus.

As is apparent from the above description, the present invention provides a canal type earphone with a pressure equilibrium means, capable of eliminating a pressure difference between an external auditory meatus and an outside during wearing of the canal type earphone so as to minimize a change in sound emitted from a speaker unit and prevent damage of a user's eardrum.

In addition, the present invention provides a canal type earphone with a pressure equilibrium means, capable of forming a side air passage through which air within a tube or air within a speaker unit is discharged to a side surface of a gasket or a side surface of the speaker unit, and a rear air passage through which air in the side surface of the speaker unit is discharged rearward of the speaker unit, so as to adjust a length of an air passage and bend the air passage in a direction of 90 degrees, thereby minutely adjusting a discharge amount of air to have good sound quality.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A canal type earphone comprising:
a speaker unit;
a housing receiving the speaker unit;
an earpiece installed on an outer surface of a tube which is integrally formed at a front of the housing;
a gasket installed between the speaker unit and the housing; and
a pressure equilibrium means for discharging air within the tube or air within a space between a cover and a vibration plate of the speaker unit to a rear of the speaker unit,
wherein the pressure equilibrium means comprises:
a side air passage through which air within the tube or air within the speaker unit is discharged to a side surface of the gasket or a side surface of the speaker unit; and
a rear air passage through which air in the side surface of the gasket or the side surface of the speaker unit is discharged to the rear of the speaker unit, and
wherein the side air passage is a vent groove which is radially formed on a front or back surface of the gasket, and the vent groove is connected, at one end thereof, to a through-hole formed at a center of the gasket and connected, at another end thereof, to the side surface of the gasket.

2. A canal type earphone comprising:
a speaker unit;
a housing receiving the speaker unit;
an earpiece installed on an outer surface of a tube which is integrally formed at a front of the housing;
a gasket installed between the speaker unit and the housing; and
a pressure equilibrium means for discharging air within the tube or air within a space between a cover and a vibration plate of the speaker unit to a rear of the speaker unit,
wherein the pressure equilibrium means comprises:
a side air passage through which air within the tube or air within the speaker unit is discharged to a side surface of the gasket or a side surface of the speaker unit; and
a rear air passage through which air in the side surface of the gasket or the side surface of the speaker unit is discharged to the rear of the speaker unit, and
wherein the side air passage is a vent groove which is radially formed on a front surface of a cover integrally formed at a front end of a frame constituting the speaker unit, and the vent groove is connected, at one end thereof, to a through-hole formed at a center of the cover, and is connected, at another end thereof, to a side surface of the cover.

3. A canal type earphone comprising:
a speaker unit;
a housing receiving the speaker unit;
an earpiece installed on an outer surface of a tube which is integrally formed at a front of the housing;
a gasket installed between the speaker unit and the housing; and
a pressure equilibrium means for discharging air within the tube or air within a space between a cover and a vibration plate of the speaker unit to a rear of the speaker unit,
wherein the pressure equilibrium means comprises:
a side air passage through which air within the tube or air within the speaker unit is discharged to a side surface of the gasket or a side surface of the speaker unit; and
a rear air passage through which air in the side surface of the gasket or the side surface of the speaker unit is discharged to the rear of the speaker unit, and
wherein the side air passage is a vent groove which is formed on a front surface plate, the front surface plate being integrally formed at a front end of the housing such that the gasket is pressed against the front surface plate, and the vent groove is connected, at one end thereof, to a through-hole formed at a center of the front surface plate, and is connected, at another end thereof, to an edge of the front surface plate.

4. A canal type earphone comprising:
a speaker unit;
a housing receiving the speaker unit;
an earpiece installed on an outer surface of a tube which is integrally formed at a front of the housing;
a gasket installed between the speaker unit and the housing; and
a pressure equilibrium means for discharging air within the tube or air within a space between a cover and a vibration plate of the speaker unit to a rear of the speaker unit,
wherein the pressure equilibrium means comprises:
a side air passage through which air within the tube or air within the speaker unit is discharged to a side surface of the gasket or a side surface of the speaker unit; and a rear air passage through which air in the side surface of the gasket or the side surface of the speaker unit is discharged to the rear of the speaker unit, and wherein the side air passage is a vent hole formed on a cover and a vent groove formed on a back surface of the gasket installed on a front surface of the cover, the vent hole is formed at a position spaced apart from a through-hole formed at a center of the cover by a predetermined distance, and the vent groove is connected, at one end thereof, to the vent hole, and is connected, at another end thereof, to the side surface of the gasket.

5. A canal type earphone comprising:

a speaker unit;

a housing receiving the speaker unit;

an earpiece installed on an outer surface of a tube which is integrally formed at a front of the housing;

a gasket installed between the speaker unit and the housing; and a pressure equilibrium means for discharging air within the tube or air within a space between a cover and a vibration plate of the speaker unit to a rear of the speaker unit, wherein the pressure equilibrium means comprises:

a side air passage through which air within the tube or air within the speaker unit is discharged to a side surface of the gasket or a side surface of the speaker unit; and a rear air passage through which air in the side surface of the gasket or the side surface of the speaker unit is discharged to the rear of the speaker unit, and wherein the side air passage is a first vent hole formed on the gasket installed on a front surface of a cover, a vent groove formed on a back surface of the gasket, and a second vent hole formed on the cover, the first vent hole is formed at a position spaced apart from a through-hole formed at a center of the gasket by a predetermined distance, the second vent hole is formed at a position spaced apart from a through-hole formed at a center of the cover by a predetermined distance, the first vent hole has a diameter greater than the second vent hole, a damping film is attached to an upper end opened surface of the first vent hole so that the upper end opened surface is closed, and the vent groove is connected, at one end thereof, to the first vent hole, and is connected, at another end thereof, to the second vent hole.

6. A canal type earphone comprising:

a speaker unit;

a housing receiving the speaker unit;

an earpiece installed on an outer surface of a tube which is integrally formed at a front of the housing;

a gasket installed between the speaker unit and the housing; and a pressure equilibrium means for discharging air within the tube or air within a space between a cover and a vibration plate of the speaker unit to a rear of the speaker unit, wherein the pressure equilibrium means comprises:

a side air passage through which air within the tube or air within the speaker unit is discharged to a side surface of the gasket or a side surface of the speaker unit; and a rear air passage through which air in the side surface of the gasket or the side surface of the speaker unit is discharged to the rear of the speaker unit, and wherein the side air passage comprises a first through-hole formed at a center of a cover and a second through-hole formed on a side surface of a frame constituting the speaker unit, and the second through-hole is formed between the cover and the vibration plate installed within the frame.

7. A canal type earphone comprising:

a speaker unit;

a housing receiving the speaker unit;

an earpiece installed on an outer surface of a tube which is integrally formed at a front of the housing;

a gasket installed between the speaker unit and the housing; and a pressure equilibrium means for discharging air within the tube or air within a space between a cover and a vibration plate of the speaker unit to a rear of the speaker unit, wherein the pressure equilibrium means comprises:

a side air passage through which air within the tube or air within the speaker unit is discharged to a side surface of the gasket or a side surface of the speaker unit; and a rear air passage through which air in the side surface of the gasket or the side surface of the speaker unit is discharged to the rear of the speaker unit, and wherein the rear air passage is a vent groove formed on an inside surface of a frame constituting the speaker unit.

8. A canal type earphone comprising:

a speaker unit;

a housing receiving the speaker unit;

an earpiece installed on an outer surface of a tube which is integrally formed at a front of the housing;

a gasket installed between the speaker unit and the housing; and a pressure equilibrium means for discharging air within the tube or air within a space between a cover and a vibration plate of the speaker unit to a rear of the speaker unit, wherein the pressure equilibrium means comprises:

a side air passage through which air within the tube or air within the speaker unit is discharged to a side surface of the gasket or a side surface of the speaker unit; and a rear air passage through which air in the side surface of the gasket or the side surface of the speaker unit is discharged to the rear of the speaker unit, and wherein the rear air passage is a through-hole formed at one side of a cover and a vent groove formed on an inside surface of a frame constituting the speaker unit such that the vent groove is connected to the through-hole.

9. A canal type earphone comprising:

a speaker unit;

a housing receiving the speaker unit;

an earpiece installed on an outer surface of a tube which is integrally formed at a front of the housing;

a gasket installed between the speaker unit and the housing; and a pressure equilibrium means for discharging air within the tube or air within a space between a cover and a vibration plate of the speaker unit to a rear of the speaker unit, wherein the pressure equilibrium means comprises:

an inside rear air passage through which air within the tube is discharged between a bracket and a yoke of the speaker unit;

an inside front air passage through which air between the yoke and the bracket is discharged to a front of the speaker unit; and a rear air passage through which air in the front of the speaker unit is discharged to the rear of the speaker unit.

10. The canal type earphone according to claim 9, wherein the inside rear air passage is a vent hole formed at one side of a cover and a vent groove formed on an inside surface of a frame constituting the speaker unit, the vent hole is installed at a position spaced apart from a through-hole formed at a center of the cover and a side surface of the gasket by a predetermined distance, and the vent groove is connected, at an upper end thereof, to the vent hole, and is connected, at a lower end thereof, between the yoke and the bracket.

11. The canal type earphone according to claim 9, wherein the inside front air passage is a vent groove formed on an inside surface of a frame constituting the speaker unit and a vent hole formed at one side of a cover, the vent hole is installed at a position spaced apart from a through-hole formed at a center of the cover and a side surface of the gasket by a predetermined distance, and the vent groove is connected, at an upper end thereof, to the vent hole, and is connected, at a lower end thereof, between the yoke and the bracket.

* * * * *